US005690324A

United States Patent [19]

Otomo et al.

[11] Patent Number: 5,690,324

[45] Date of Patent: Nov. 25, 1997

[54] SORTER FOR A STENCIL PRINTER AND PAPER TRANSPORT SPEED CONTROL DEVICE FOR SORTER

[75] Inventors: Tomoya Otomo, Sendai; Hiromi Omura, Natori; Toshiharu Hasegawa, Shiroishi, all of Japan

[73] Assignees: Tohoku Ricoh Co., Ltd., Miyagi-ken; Canon Aptex Inc., Mitsukaido, both of Japan

[21] Appl. No.: 527,921

[22] Filed: Sep. 14, 1995

[30] Foreign Application Priority Data

Dec. 14, 1994 [JP] Japan ..... 6-310989

[51] Int. Cl.[6] ..... B65H 39/02

[52] U.S. Cl. ..... 270/58.02; 270/58.04; 270/58.14; 271/292

[58] Field of Search ..... 270/58.02, 58.04, 270/58.08, 58.14; 271/270, 292, 293, 294, 197, 202; 355/322, 323, 324; 101/2, 90

[56] References Cited

U.S. PATENT DOCUMENTS

| | | | |
|---|---|---|---|
| 4,478,406 | 10/1984 | DuBois . | |
| 4,746,111 | 5/1988 | Naramore | 271/292 X |
| 4,974,828 | 12/1990 | Matsuo et al. | 271/270 X |
| 5,042,793 | 8/1991 | Miyake | 271/293 |
| 5,181,705 | 1/1993 | Ueda et al. | 271/202 X |
| 5,186,454 | 2/1993 | Kitahara | 271/292 X |
| 5,253,860 | 10/1993 | Hirose et al. | 271/270 X |
| 5,255,908 | 10/1993 | Hiroi et al. | 271/294 X |
| 5,279,217 | 1/1994 | Ueda et al. . | |
| 5,279,218 | 1/1994 | Oshio et al. | 270/58.02 X |
| 5,422,705 | 6/1995 | Omelchenko et al. | 355/323 X |

FOREIGN PATENT DOCUMENTS

| | | | |
|---|---|---|---|
| 60-248566 | 12/1985 | Japan . | |
| 61-136865 | 6/1986 | Japan . | |
| 2 5636 | 2/1990 | Japan . | |
| 2 175561 | 7/1990 | Japan . | |
| 3-6104 | 1/1991 | Japan . | |
| 3-106752 | 5/1991 | Japan | 271/270 |
| 5-18342 | 5/1993 | Japan . | |
| 5 229243 | 9/1993 | Japan . | |
| 5-318899 | 12/1993 | Japan . | |
| 6 32039 | 2/1994 | Japan . | |
| 6 239002 | 8/1994 | Japan . | |

*Primary Examiner*—Hoang Nguyen

*Attorney, Agent, or Firm*—Oblon, Spivak, McClelland, Maier & Neustadt, P.C.

[57] ABSTRACT

A sorter having an intermediate transport device using a belt and for transporting printings to bins, and a transport speed control device for changing the transport speed depending on the size of the printings, and the type of the printings including thickness and quality, such that the transport device transports the printings at an optimal speed. The trailing edge portions of the printings are prevented from being left at the outside of the bins and causing jams and other troubles to occur.

29 Claims, 12 Drawing Sheets

1
3
111
112
110
ROM
RAM
PRINTER CPU
ADF & READING DEVICE
MASTER MAKE & FEED MECHANISM
MASTER DISCHARGE MECHANISM
PAPER FEED MECHANISM
PRINT MECHANISM
PAPER DISCHARGE MECHANISM
113
114
115
116
117
118
PAPER SIZE
PAPER TYPE
PAPER SIZE
SIZE SENSORS
38(38a, 38b, 38c, 38d), 39
KEYS
PAPER SIZE SET KEY
INDICATOR
PANEL
78, 79
81~83,
85~87
89, 92
94~96
86
90, 91, 77
80

SORTER FOR A STENCIL PRINTER AND PAPER TRANSPORT SPEED CONTROL DEVICE FOR SORTER

BACKGROUND OF THE INVENTION

The present invention relates to an image forming apparatus and, more particularly, to a sorter advantageously applicable to a stencil printer, and a paper transport speed control device for the sorter.

A sorter having a plurality of bins is extensively used with & stencil printer or similar printer or a copier, laser printer or similar electrophotographic image recording apparatus. The sorter automatically sorts printings or copies (referred to as papers hereinafter) sequentially coming out of the printer or the recording apparatus to its bins. Japanese Patent Laid-Open Publication No. 5-318899, for example, discloses a sorter having a bin unit having a stack of bins, and connected to the paper outlet of a stencil printer. The bin unit is movable up and down in a reciprocating motion. Particularly, the above document teaches a system for controlling the printing speed of the printer in matching relation to the operation of the sorter. On the other hand, Japanese Patent Laid-Open Publication No. 2-17556, for example, proposes a sorter of the type distributing papers to its bins by use of rollers in interlocked relation to a copier. Particularly, this document teaches a method of controlling a transport speed of an intermediate transport device, which transports the papers from the copier to the bins, to a speed matching a sort mode or a speed matching a stack mode. Further, Japanese Patent Laid-Open Publication No. 6-32039 proposes an implementation for preventing ink from being transferred from the front of an underlying paper to the rear of an overlying paper.

As to the undesirable transfer of the ink to the rear of an overlying paper, if the bin unit is lowered or elevated to its home position at a high speed, a sufficient period of time is not available for the ink deposited on papers to dry. In this connection, Japanese Patent Application No. 6-100886 reports the following results of experiments. When the bin unit accommodating papers in its bins was lowered or elevated to the home position at a higher speed, an adequate degree of vibration acted on the bins and caused the papers protruding from the bins to return due to the inclination of the bins. As a result, the vibration served to enhance the accurate positioning of the papers. However, the higher speed of movement of the bin unit aggravated the noise and vibration of the entire sorter. The trade-off between the merit and the demerit particular to the increase in moving speed depends on the user's or operator's needs.

SUMMARY OF THE INVENTION

It is, therefore, an object of the present invention to provide a sorter for a stencil printer and capable of setting up an optimal paper transport speed for each size, orientation and type, including thickness and quality, or papers, and a paper transport speed control device for the sorter.

It is another object of the present invention to provide a sorter for a stencil printer and capable of preventing the trailing edge portion of a paper from failing to be received in a bin and causing a jam or similar trouble to occur, and a paper transport speed control device for the sorter.

It is still another object of the present invention to provide a sorter for a stencil printer and capable of surely positioning papers on bins while solving the noise and vibration problem.

It is a further object of the present invention to provide a sorter for a stencil printer and capable of preventing ink from being transferred from the front of an underlying paper to the rear of an overlying paper.

In accordance with the present invention, a sorter for sorting papers sequentially coming out of an image forming apparatus and each carrying an image thereon has a bin unit having a plurality of bins for receiving and stacking the papers. An intermediate transport unit intervenes between the bin unit and the image forming apparatus and transports the papers to the bin unit at a predetermined transport speed. A transport speed control unit controls the predetermined transport speed on the basis of a predetermined parameter particular to the papers.

Also, in accordance with the present invention, a device for controlling an intermediate transport unit for transporting papers sequentially coming out of an image forming apparatus to a plurality of bins of a bin unit of a sorter at a predetermined transport speed has a size detecting arrangement for detecting the size of the papers. A controller changes the predetermined transport speed on the basis of the size detected.

Further a device for controlling an intermediate transport unit for transporting papers sequentially coming out of an image forming apparatus to a plurality of bins of a bin unit of a sorter at a predetermined transport speed of the present invention has a paper type setting arrangement for setting the type of the papers including at least one of a thickness and a quality. A controller changes the predetermined transport speed on the basis of the type set. Moreover, in accordance with the present invention, a device for controlling an intermediate transport unit for transporting papers sequentially coming out of an image forming apparatus to a plurality of a bin unit of a sorter at a predetermined transport speed has a size setting arrangement for setting the size of the papers. A controller changes the predetermined transport speed on the basis of the size set.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
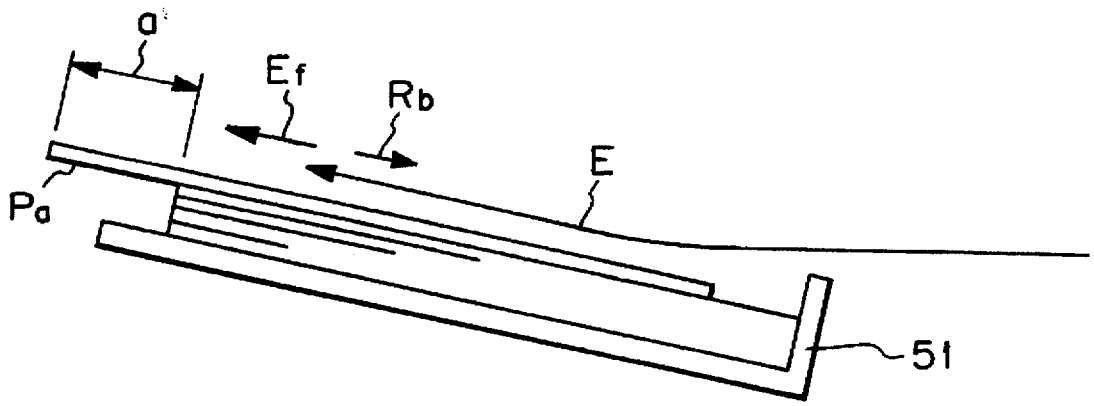
Fig. 1 PRIOR ART
FIGS. 1 and 2 are sections each showing a specific condition of defective paper positioning to occur in a conventional movable bin unit type sorter.
Figure 2:
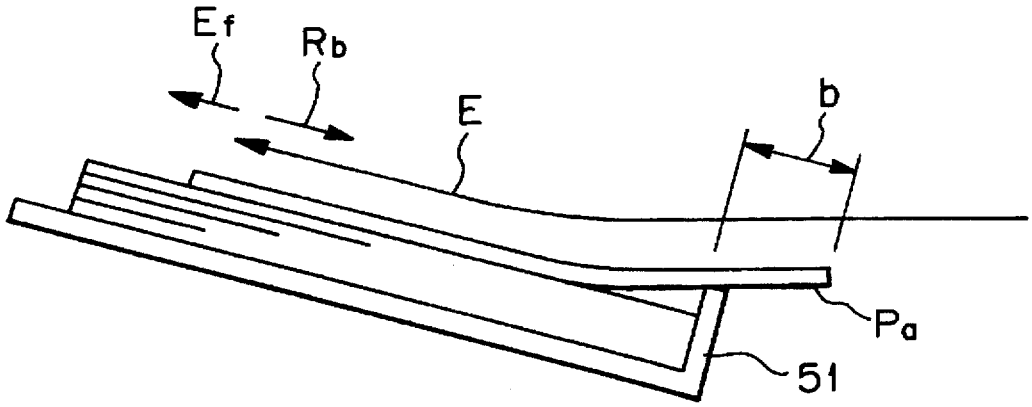
Fig. 2 PRIOR ART

To better understand the present invention, the problems with a conventional sorter will be described specifically. FIGS. 1 and 2 demonstrate how a paper or printing driven out of a stencil printer via an outlet and conveyed by an intermediate transport device using a belt is driven into the bin of a movable bin unit type sorter. As shown, a bin 51 is constantly inclined upward toward the downstream side in the intended direction of paper transport E, i.e., in the direction in which a paper enters the bin 51. A paper or printing Pa, coming out of the intermediate transport device is driven into the bin 51 while rubbing its leading edge and rear against the upper surface of the bin 51 or that or the paper Pa existing in the bin 51. At this instant, the paper Pa entering the bin 51 is subjected to a conveying force Ef acting in the direction E and a resistance Rb acting in the opposite direction. The resistance Rb depends on the paper size, the orientation of the paper with respect to the direction E, the edge configuration of the paper, the type of the paper, including thickness and quality, the area of the paper occupied by an image, etc. Assume that all the papers Pa are driven into the bin 51 at a fixed speed. Then; the conveying speed decreases when it comes to, for example a relatively large or relatively thick paper which is subjected to a greater resistance Rb than ordinary papers. As a result, as shown FIG. 2, the trailing edge portion of the paper Pa is left at the outside of the bin 51 in an amount b. This obstructs positioning of the papers Pa on the bin 51. Moreover, it is likely that the next paper Pa coming out of the intermediate transport device abuts against the trailing edge of the protruding paper Pa and thereby jams the sorter. On the other hand, assume that the conveying speed is increased in order to prevent the trailing edge portion of the paper Pa from being left at the outside of the bin 51. Then, as shown FIG. 1, a relatively small paper having a smooth print surface, for example, slides out of the bin 51 at its leading edge portion by an amount a because the resistance Rb acting thereon is comparatively small. This also obstructs the positioning of papers Pa on the bin 51.

The decrease in the conveying speed due to the resistance Rb is more conspicuous in a printer, particularly a stencil printer, than in a copier or similar electrophotographic recording apparatus. Specifically, ink transferred to a paper by a stencil printer is fixed thereon by natural drying. Hence, the ink on the paper Pa driven into the bin 51 is still wet when the next paper Pa is stacked thereon. At this instant, the leading edge and rear of the next paper Pa rub against the image surface of the existing paper Pa, so that the resistance Rb acting on the next paper Pa is increased due to the transfer of the ink from the existing paper Pa. The transfer of the ink the next paper Pa and, therefore, the resistance Rb acting thereon increases with an increase in the image area of the paper Pa. Presumably, in a copier, the resistance Rb increases little because toner deposited on a paper has been substantially fully fixed on the paper when the paper is driven into a bin.

The decrease in the conveying speed attributable to the resistance Rb increased by the ink deposition is particularly noticeable when the intermediate transport device, intervening between the printer and the sorter, is implemented by a belt, for the following reasons. An intermediate transport device using rollers and often installed in a copier is capable or surely nipping a paper with rollers. However, the device using a belt simply conveys the paper Pa while sucking it with a fan. With this kind of device, it is difficult to convey the paper Pa while retaining it on the belt with an intense force. In a stencil printer, among others, if the paper Pa is nipped by rollers, the non-fixed ink on the image surface of the paper Pa will be transferred to the rollers. This results in a so-called roller marks. This is why a stencil printer must be implemented with the transport system using a belt and a fan. It is farther necessary that the paper Pa driven into the bin 51 be entirely received in the bin 51 up to the trailing edge and be prevented from sliding out of the bin 51 or protruding from the same. This cannot be done unless the paper Pa is introduced into the sorter at an adequate speed which is not excessively high or excessively low.

Preferred embodiments of the present invention will be described which eliminate the problems discussed above.

1st Embodiment

Figure 3:
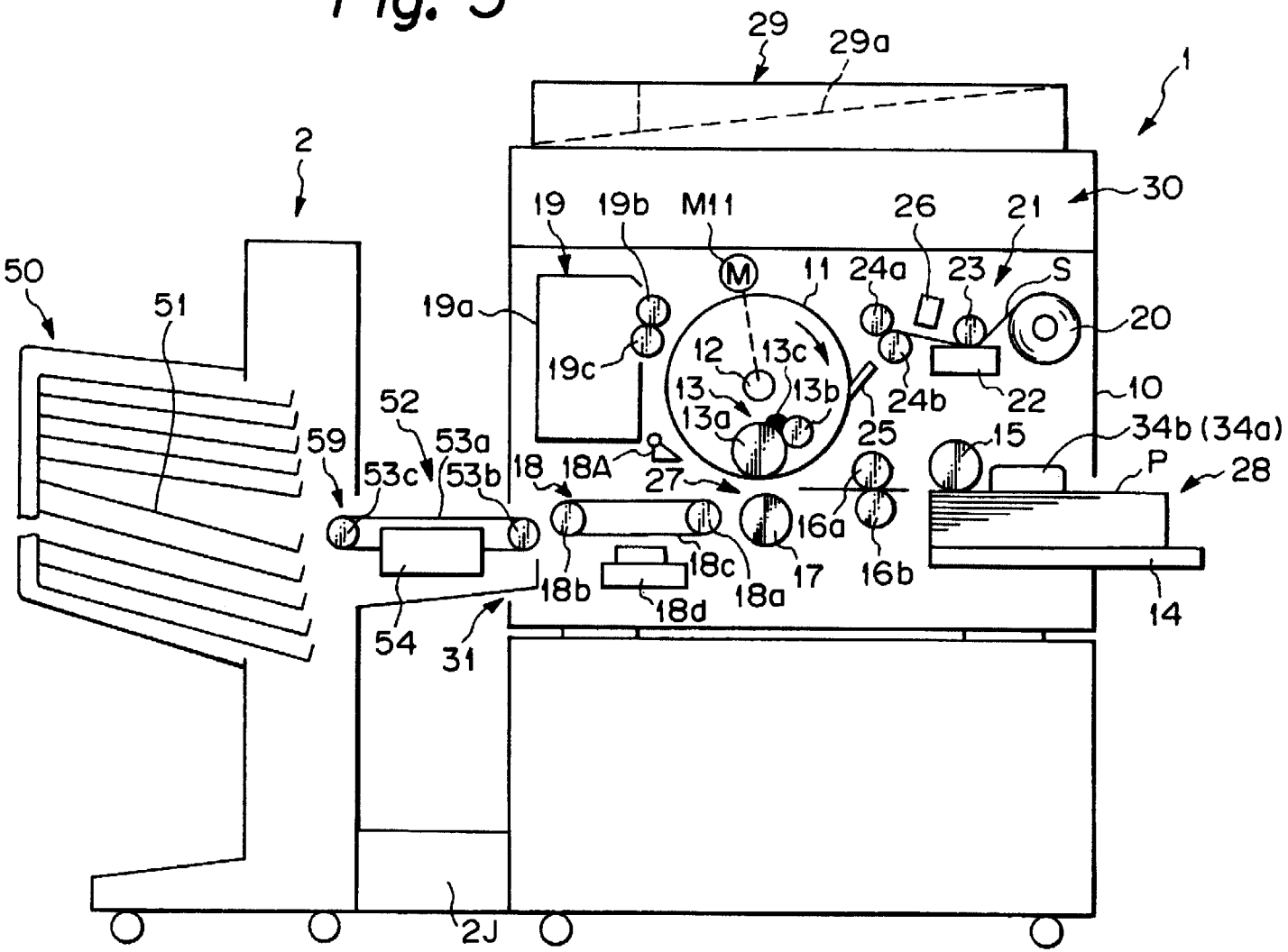
FIG. 3 is a section showing a movable bin unit type sorter embodying the present invention and connected to a stencil printer.

Referring to FIG. 3, there is shown a system consisting of a stencil printer 1 and a movable bin unit type sorter 2 embodying the present invention. It is to be noted that the printer 1 is a specific form of an image forming apparatus with which the embodiment is practicable. The embodiment includes an arrangement disclosed in previously mentioned Japanese Patent Application No. 6-100886.

In FIG. 3, the printer 1 prints the image of a document, not shown, on a paper P. The sorter 2 has a bin unit 50 having a stack of bins 51. The bin unit 50 is movable up or down in order to receive papers or printings, not shown, sequentially coming out of the printer 1 in its bins 51. Specifically, a paper coming out of an outlet 31 formed in the printer 1 is transported to any one of the bins 51 by an intermediate transport device 52. The sorter 2 is, therefore, connected to the outlet 31 of the printer 1 by the transport device 52. Further, the printer 1 and sorter 2 are connected by a connecting member 2J at their bottoms and are electrically connected by a communication line, not shown. More specifically, an ADF (Automatic Document Feeder) 29 is mounted on the top of a printer housing or cabinet 10 and is openable, as needed. The ADF 29 sequentially feeds a plurality of documents to a reading section 30 while collecting them automatically. At the reading section 30, the documents are sequentially read by optics, not shown. A master making section 21 is disposed below the reading section 30 and in the vicinity of one side wall of the cabinet 10. The section 21 pays out a stencil S from a roll and perforates it to make a master. A printing section 27 is positioned substantially at the center of the cabinet 10 and includes a print drum 11 for wrapping the master therearound. A paper feed section 28 is located below the master making section 21 and reeds papers P stacked on a tray 14 to below the printing section 27 one by one. A paper discharge section 18 is positioned at the side opposite to the paper feed section 28 and discharges a paper or printing coming out of the printing section 27 to the intermediate transport device 52. A master discharge section 19 is interposed between the paper discharge section 18 and the reading section 30 and discharges a used master, not shown, removed from the print drum 11 into a waste master box 19*a*.

The ADF 29 has a tray 29*a* to be loaded with a stack of documents, a roller pair for separating the lowermost document from the stack on the tray 29*a* and feeding it, motors of paper feed, transport and discharge, and other conventional mechanisms. The reading section 30 may be implemented by the arrangement taught in, for example, Japanese Patent Laid-Open Publication No. 5-229243. The master making section 21 has a master storing portion 20 storing the stencil S in the form of a roll, a thermal head 22 for selectively perforating the stencil S paid out from the roll in accordance with image data by heat, a platen roller 23 for conveying the stencil S to the downstream side white pressing it against the head 22, a cutter 26 for cutting the stencil S, and roller pairs 24*a* and 24*b* interposed between the print drum 11 and the cutter 26 for conveying the perforated stencil or master S toward a master clamper 25 mounted on the drum 11.

In the printing section 27, the print drum 11 is implemented as a porous hollow cylinder and rotated about a center shaft 12 by a DC motor M11 via a gearing or similar drive transmitting means. The master clamper 25, mounted on the drum 11 is openable to clamp the leading edge of the master S. Ink supply means 13 is arranged in the drum 11 to supply ink to the inner periphery of the drum 11. The ink supply means 13 may be constructed as taught in, for example, Japanese Patent Laid-Open Publication No. 5-229243. Specifically, the ink supply means 13 has an ink roller 13*a* for supplying ink to the inner periphery of the drum 11, a doctor roller 13*b* parallel to and spaced from the ink roller 13*a* by a small gap and forming a wedge-like ink well 13*c* in cooperation with the roller 13*a*, and an ink supply tube 12 for supplying ink to the ink well 13*c* while serving as the center shaft 12. The drum 11 is rotatably supported by frame, not shown. This frame is removably retained by retaining means, not shown, which is, in turn, affixed to the cabinet 10 above the drum 11. The frame and retaining means may be provided with a configuration disclosed in, for example, Japanese Patent hid-Open Publication No. 5-229243. The drum 11 is, therefore, removably mounted to the cabinet 10. A press roller 17 is located below the drum 11 and movable toward and away from the drum 11. The press roller 17 presses the paper P fed from the paper feed section 28 against the drum 11.

Figure 7:
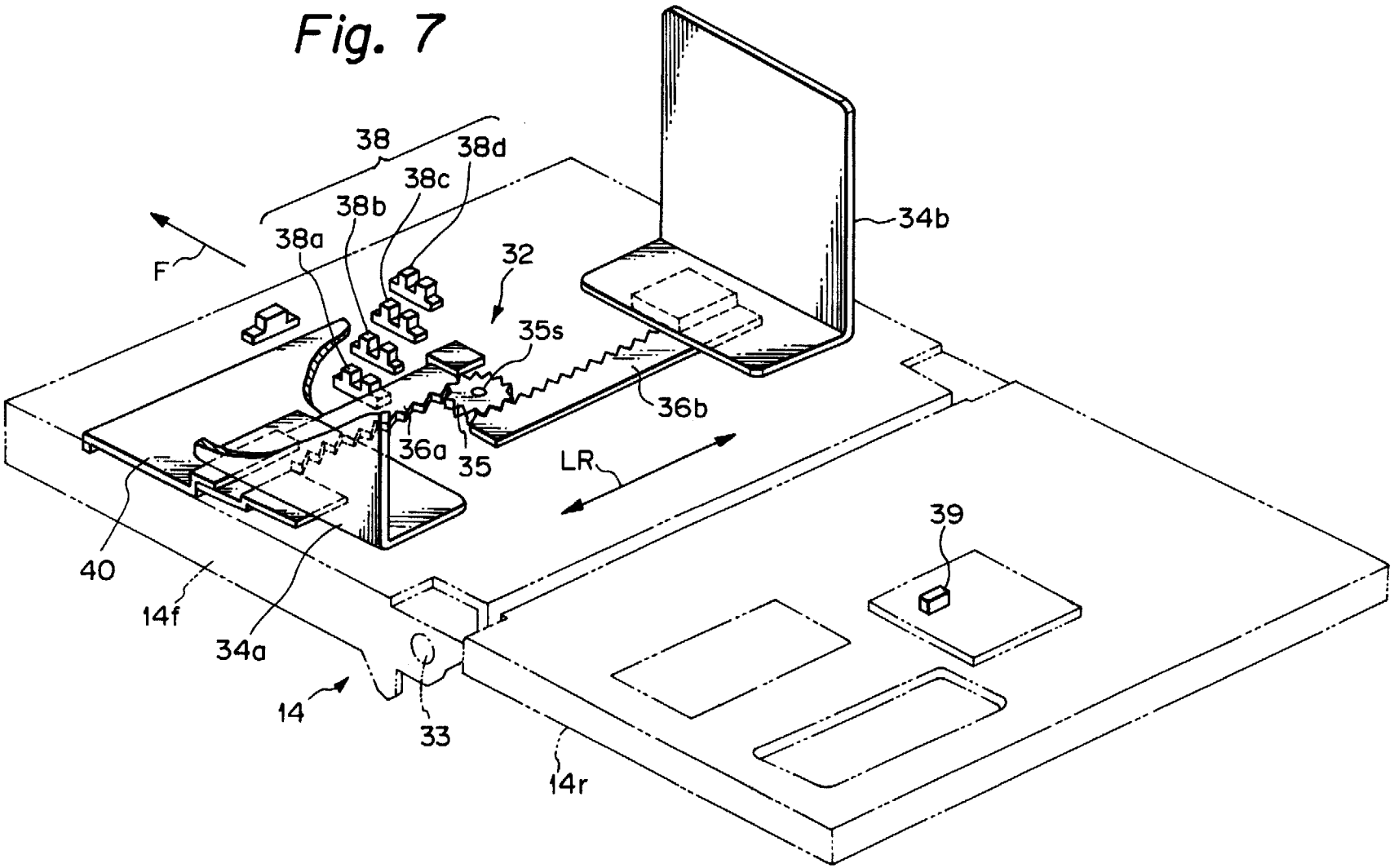
FIGS. 7 and 8 are perspective views of size sensors included in the embodiment, and arrangements surrounding them.
Figure 8:
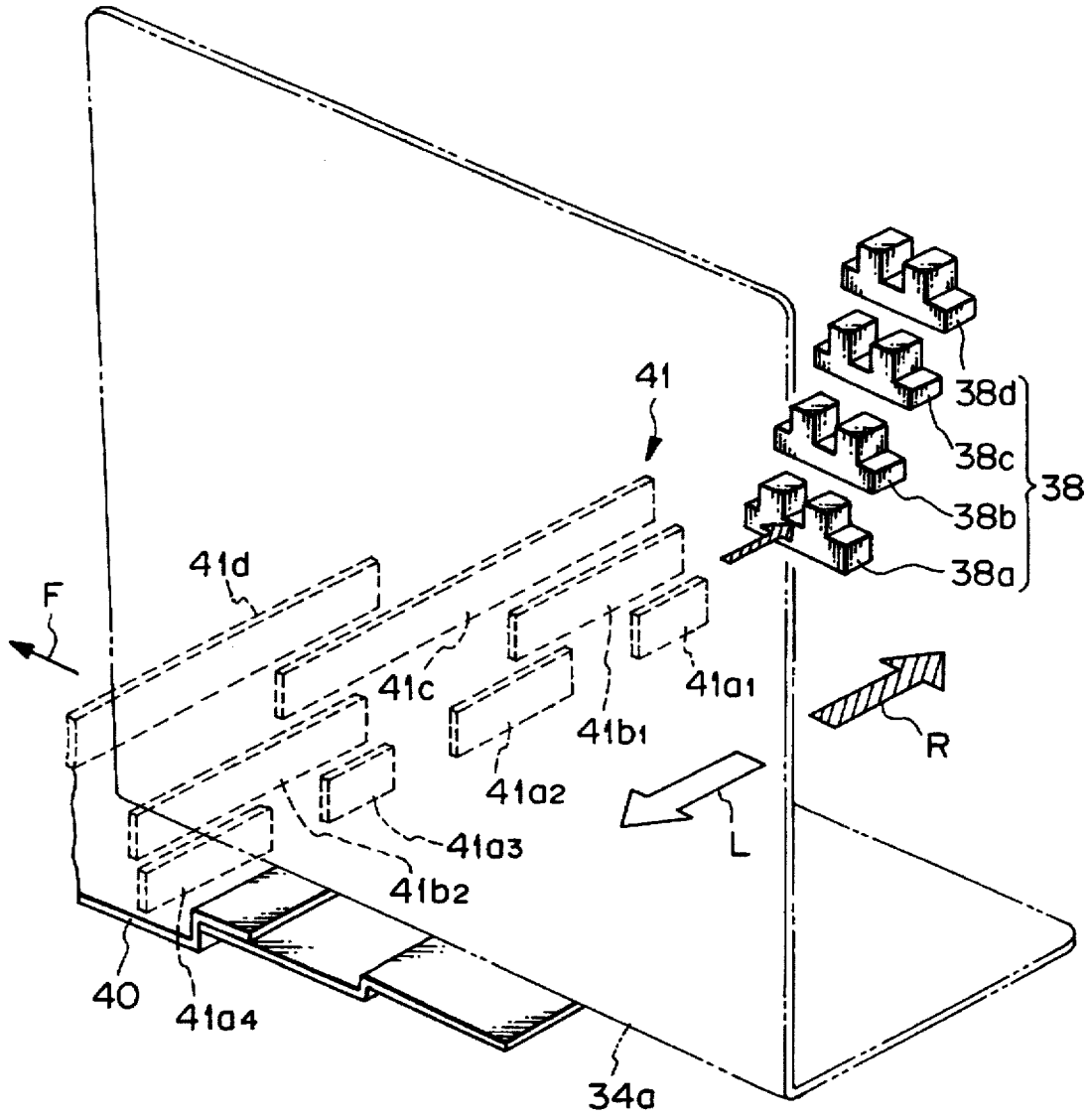
Figure 9:
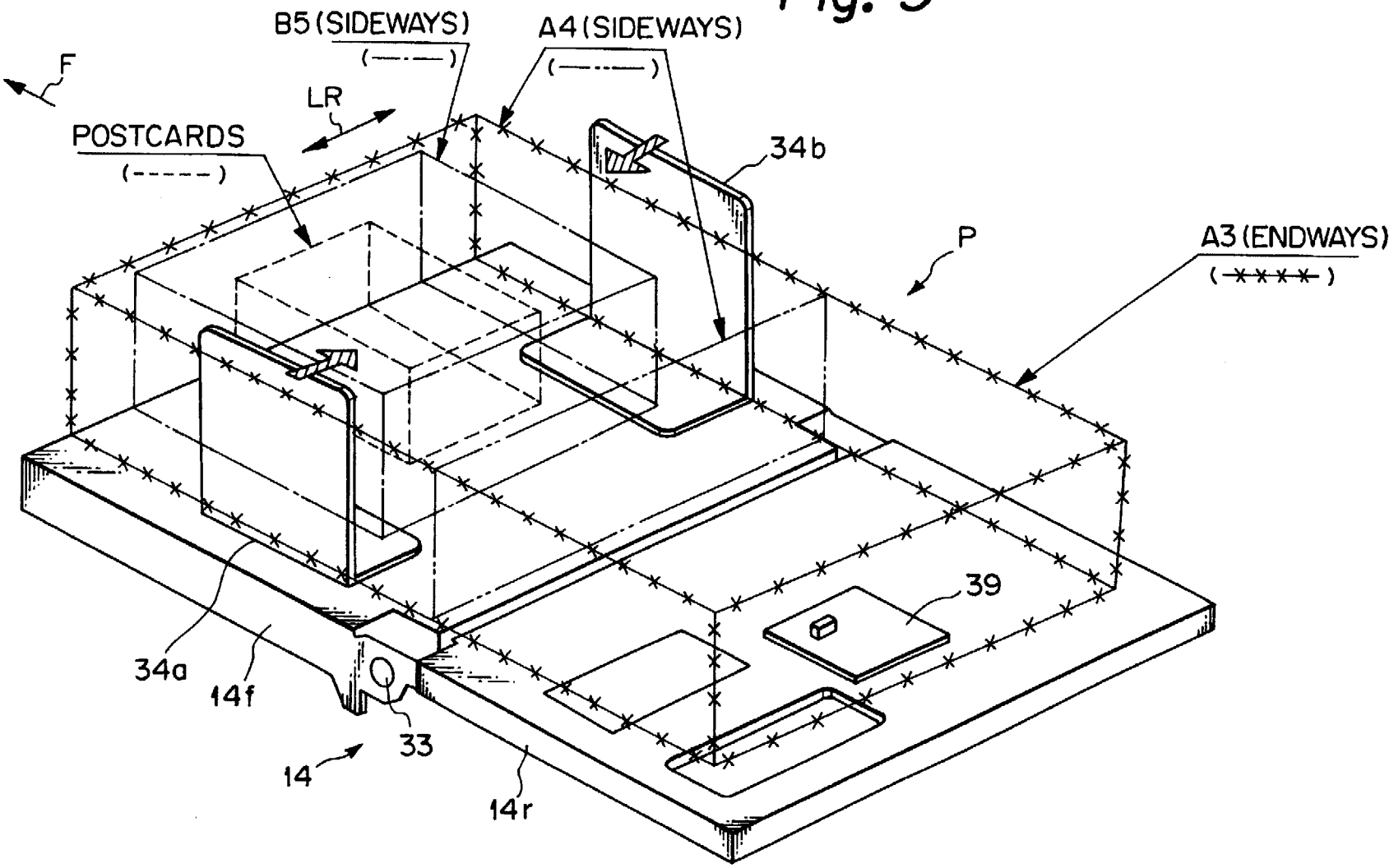
FIG. 9 is a perspective view showing papers of various predetermined sizes stacked on a tray included in the embodiment, and a mechanism for sensing their sizes.

In the paper feed section 28, a pick-up roller 15 rests on the uppermost one of the papers P stacked on the tray 14 and feeds it while separating it from the others. A registration roller pair 16*a* and 16*b* is positioned downstream of the pick-up roller 15 in the paper feed direction and conveys the paper P to between the drum 11 and the press roller 17 at a predetermined timing. The tray 14 is disposed between a pair of side panels, not shown, affixed to the cabinet 10 and moved up and down by an elevation mechanism, not shown. As shown in FIGS. 7–9, the tray 14 is made up of a front 14*f* and a rear half 14*r* hinged to the front half 14*f* such that the rear half 14*r* can be raised relative to the front half 14*f* about a hinge 33. A pair of side fences 34*a* and 34*b* are slidable toward and away from each other along a slot formed in the front half 14*f* in the lateral or widthwise direction LR papers P. A side guide mechanism 32 is mounted on the rear of the front half 14*f* to position the papers P in the lateral direction LR.

The side guide mechanism 32 bas a pair of racks 36*a* and 36*b* and a pinion 35. The racks 36*a* and 36*b* are respectively affixed to one end of the side fences 34*a* and 34*b* at the rear of the front half 14*f*, and each is formed with teeth at one edge thereof. The racks 36*a* and 36*b* are slidable in the direction LR. The pinion 35 is interposed between and held in mesh with the racks 36*a* and 36*b* and mounted on a pinion shaft 35*s* affixed to the rear of the front half 14*f*. The racks 36*a* and 36*b* and the undersides of the side fences 34*a* and 34*b* sandwich the front half 14*f*.

As shown in FIGS. 7 and 8, a screen plate 40 is mounted on the other edge of the rack 36*a* and supports a group of screens 41 thereon. The screens 41 each extends over a particular length and is spaced from the adjoining ones in the direction LR and the paper feed direction F. Specifically, the screens 41 are comprised of screens 41$a_1$, 41$a_2$, 41$a_3$ and 41$a_4$ forming an array, screens 41$b_1$ and 41$b_2$ forming another array, and screens 41*c* and 41*d* each forming a respective array. A group of size sensors or size sensing means 38 are affixed to the rear of the front hair 14*f* in order to sense the size of the papers P (including an orientation) stacked on the tray 14. The size sensors 38 are comprised of four size sensors 38*a*, 38*b*, 38*c* and 38*d* spaced from each other by predetermined distances in the directions LR and F. The size sensors 38*a*, 38*d* are each implemented as a conventional photointerrupter having a light emitting element and a light-sensitive element. The size sensors 38*a*–38*d* are selectively engageable with the screens 41$a_1$–41$a_4$, screens 41$b_1$ and 41$b_2$, screen 41*c*, and screen 41*d*, thereby sensing relatively small paper sizes.

As shown in FIGS, 7 and 9, a size sensor or size sensing means 39 is affixed to the rear of the rear half 14*r* to sense the size of the papers P. The sensor 39 is a reflection type sensor made up of a light emitting element and a light-sensitive element. When the papers P are present on the rear hair 14*r*, the sensor 39 is turned on by sensing a reflection from the the bottom of the papers P. The sensor 39 is used to sense relatively large paper sizes in combination with the sensors 38*a*–38*d*. The sensors 38*a*–38*d* and 39 are electrically connected to paper transport speed control means which will be described.

As shown in FIG. 9, assume that postcards are stacked on the tray 14 or that papers of sizes B5 sideways, A4 sideways or A3 endways are stacked thereon. Then, the side fences 34*a* and 34*b* are slid toward each other to position the postcards or the papers in the direction LR. The screen plate 40 is moved together with the side fence 34*a*. As a result, the positional relation between the size sensor 38*a* and the screens 41$a_1$–41$a_4$, the positional relation between the size sensor 38*b* and the screens 41$b_1$ and 41$b_2$, the positional relation between the size sensor 38*c* and the screen 41*c*, and the positional relation between the size sensor 38*d* and the screen 41*d* are determined on the basis of the paper size. As a result, the length of the papers P in the direction LR (widthwise size) is determined on the basis of the combination of the outputs of the size sensors 38*a*–38*d*, as listed in Table 1 below.

However, the positions of the side fences 34*a* and 34*b* show only the widthwise size of the papers P. For example, papers of size A4 positioned sideways and papers of size A3 positioned endways are of the same size in the direction LR and cannot be distinguished from each other. In light of this, the output of the size sensor 39 is combined with the outputs of the size sensors 38*a*–38*d*. For example, the sensor 39 indicates that papers of size A3 are positioned endways in the direction F when it is turned on or that papers of size A4 are positioned sideways when it is turned off. The previously mentioned paper transport speed control means determines the size of the papers P on the basis of the combination of the outputs of the size sensors 38*a*–38*d* and 39.

TABLE 1

| Paper Size Sensor | | | | | | |
|---|---|---|---|---|---|---|
| 38a | 38b | 38c | 38d | 39 | Paper | Size |
| — | — | — | — | — | * | 318 × 210 (mm) |
| o | — | — | — | — | A4 sideways | 297 × 210 |
| o | o | — | — | — | * | 288 × 210 |

TABLE 1-continued

| Paper Size Sensor | | | | | | |
|---|---|---|---|---|---|---|
| 38a | 38b | 38c | 38d | 39 | Paper | Size |
| — | o | — | — | — | LT sideways | 280 × 216 |
| — | o | o | — | — | * | 268 × 216 |
| o | o | o | — | — | B5 sideways | 257 × 182 |
| o | — | o | — | — | * | 236 × 182 |
| — | — | o | — | — | A4 endways | 210 × 297 |
| — | — | o | o | — | LT endways | 216 × 280 |
| o | — | o | o | — | * | 196 × 297 |
| o | o | o | o | — | B5 endways | 182 × 257 |
| — | o | o | o | — | * | 166 × 257 |
| — | o | — | o | — | A5 endways | 148 × 210 |
| o | o | — | o | — | * | 124 × 210 |
| o | — | — | o | — | postcard | 100 × 148 |
| — | — | — | o | — | * | 90 × 148 |
| — | — | — | — | o | * | 318 × 420 |
| o | — | — | — | o | A3 endways | 297 × 420 |
| o | o | — | — | o | * | 288 × 420 |
| — | o | — | — | o | DLT endways | 280 × 432 |
| o | o | o | — | o | B4 endways | 257 × 364 |
| o | — | o | — | o | * | 236 × 364 |
| — | — | o | — | o | LG endways | 216 × 356 |
| — | — | o | o | o | * | 210 × 297 |
| o | — | o | o | o | * | 196 × 297 |
| o | o | o | o | o | * | 182 × 257 |
| — | o | o | o | o | * | 166 × 257 |
| — | o | — | o | o | HLT | 148 × 210 |
| o | o | — | o | o | * | 124 × 210 |
| o | — | — | o | o | * | 100 × 148 |
| — | — | — | o | o | * | 90 × 148 |

In Table 1, symbols "O " and "–" are respectively representative of the ON states of the size sensors 38*a*–38*d* and 39 and the OFF states of the same. In the column of "Paper Size", "* (asterisk)" is representative of irregular sizes intervening between the regular sizes. Labeled LT, DLT, LG and HLT are a letter size, double letter size, legal size, and half letter size, respectively. Table 1 shows that each of the paper sizes shown at the right is determined on the basis of the combination of the outputs of the size sensors 38*a*–38*d* and 39 shown at the left.

The size sensor 39 is used only to determine whether or not the papers P are present in the direction F and, therefore, does not have to sense them continuously. Hence, only one or two sensors 39 suffice, as in the embodiment. Further, when images should be printed on, for example, transparent shuts, use may be made of a conventional photointerrupter having a light emitting element and a light-sensitive element, not shown, and having a feeler, not shown, capable of operating even when a single paper P is set on the tray 14. When the feeler is rotated relative to the sensor body, a sectorial screen intercepts light. This kind of sensor may be replaced with a microswitch which can be actuated by a minimum of force, if desired.

The pair of side panels and elevation mechanism mentioned previously are disclosed in, for example, Japanese Utility Model Publication No. 5-18342. Specifically, the mechanism includes a pair of racks mounted on opposite side edges of the tray 14, and each having teeth at its front edge. A motor is affixed to the outer lower periphery of one of the side panels. A worm is mounted on the output shaft of the motor. A pair of pinions are respectively mounted on a drive shaft journalled to the side panels, and respectively held in mesh with the racks. A worm wheel is mounted on the end of the drive shaft of one of the side panel and held in mesh with the worm. An upper guide shaft and a lower guide shaft are respectively studded on the racks and slidably received vertical slots. A pair of rack stays are supported by lower portions of the racks.

Referring again to FIG. 3, the paper discharge section 18 has a separator 18A adjoining the print drum 11 and for separating the paper or printing from the drum 11. A plurality of endless belts 18 are passed over rollers 18*a* and 18*b* to convey the paper separated from the drum 11 to the intermediate transport device 52. A suction fan 18*d* is disposed below the belts 18*c* for sucking the paper being conveyed by the belts 18*c*. Each belt 18*c* formed with a number of openings, not shown. In the master discharge section 19, a pair of rollers 19*b* and 19*c* are pressed against each other and pick up the trailing edge of the used master and separate it from the drum 11 in synchronism with the rotation of the drum 11. The master separated from the drum 11 is driven into the waste master box 19*a*.

Figure 10:
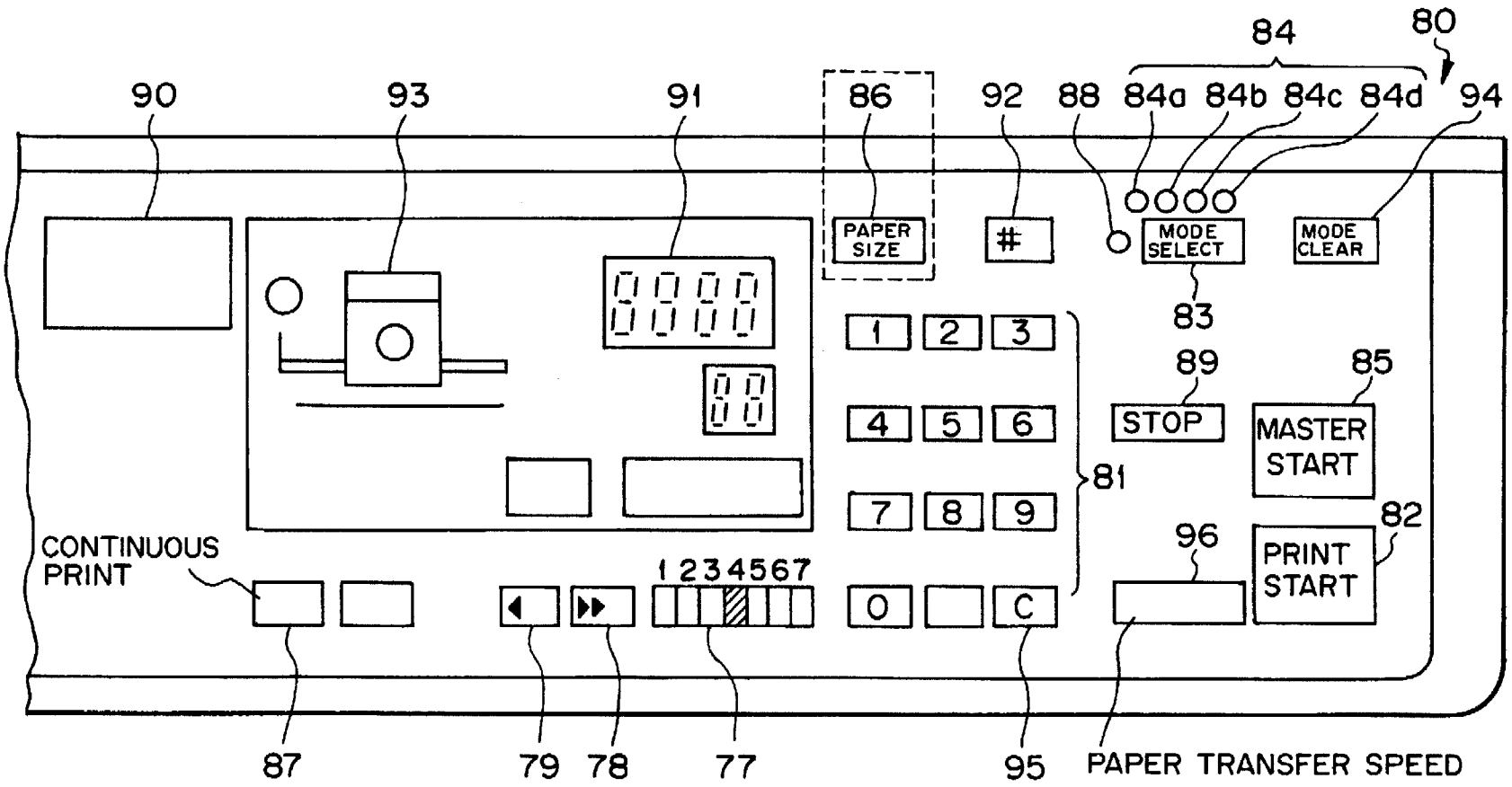
FIG. 10 is a plan view of an operation and display panel included in the embodiment and having various keys and displays arranged thereon.

FIG. 10 shows an operation and display panel 80 disposed above the reading section 30 and having the following constituents. Numeral keys 81 are accessible for entering, for example, a desired number of printings. A print start key 82 is used to start a sequence of steps terminating at a printing step. A mode select key 83 is used to select various models which will be described. LEDs (Light Emitting Diodes) 84 each indicates a particular mode selected on the key 83. A master start key 85 is operated to start the procedure beginning with the reading of a document image and ending with trial printing. A paper size set key 86 is used to set a paper size including the orientation of the papers P. A continuous print key 87 is accessible for forming two document images in a single master S continuously. An LED 88 is turned on when two or more sorters are connected together and two or more bin units are used. A stop key 89 is operated to stop the operation terminating at, for example, the printing step. An LCD (Liquid Crystal Display) 90 displays the paper size selected on the paper size set key 86, and a paper transport speed set mode and data representative of the type of papers entered on a transport speed set key 96 and numeral keys 81, etc. A display 91 is implemented by LEDs and displays the paper size selected on the key 86, the number of printings entered on the keys 81, etc. An enter key 92 is used to enter, for example, the paper transport speed set mode. A monitor display 93 displays the location and content of an error, e.g., a jam caused by the stencil S or the paper P. A mode clear key 94 is used to clear the mode selected on the key 83 and the paper transport speed set mode. A clear key 95 is used to clear, for example, the number of printings entered on the keys 81. The transport speed set key 96 constituting part of paper type setting to means is operated to start the paper transport speed set mode for changing the paper transport speed to predetermined one. The paper type setting means sets the type of the papers P, including thickness and quality, as listed in Table 2 below. In FIG. 10, the paper size set key 86 is distinguished from the other keys by a dashed block because it is not used in this embodiment. The key 86 is used in an alternative embodiment to be described.

TABLE 2

| Paper Type Data Code No. | General Type | Example |
|---|---|---|
| 15 | spare | |
| 14 | copy paper | Ricoh PPC TYPE 6200 |
| 13 | recycled paper | Ricoh paper source TYPE-S (for PPC) |
| 12 | | Ricoh paper source TYPE-A (for printing) |

TABLE 2-continued

| Paper Type Data Code No. | General Type | Example |
|---|---|---|
| 11 | thin paper | rough paper, fine quality, less than 45 kg |
| 10 | standard paper | fine quality 55–90 kg |
| 9 | paper with | non |
| 4 | high resistance jagged edges or rough surface and high coefficient of friction | level selected by user based on discharge condition |
| 3 | paper with | none |
| 0 | low resistance thin or smooth paper | level selected by user based on discharge condition |

To set the type of the papers P, the operator presses the transport speed set key 96 to star the paper transport speed set mode, and then operates the numeral keys 81 to enter one of the type data code numbers listed in Table 2. The key 96 and keys 81 constitute the paper type setting means for setting the type of the papers P, as stated earlier.

Further arranged on the operation and display panel 80 are a speed up key 78, a speed down key 79, and a speed indicator 77 implemented by LEDs. The speed up key 78 is pressed to raise the speed of the upward or downward movement of the bin unit 50 toward its home position which occurs after the distribution of the papers or printings P to the bin unit 50. The speed down key 79 is pressed to lower the speed of such a movement of the bin unit 50. The speed indicator 77 indicates the speed selected on the key 78 or 79. The keys 78 and 79 and indicator 77 constitute moving speed setting means for selecting one of a plurality of predetermined speeds at which the bin unit 50 may be raised or lowered to its home position.

The LEDs 84 are comprised of four LEDs 84*a*, 84*b*, 84*c* and 84*d* arranged in this order in a horizontal array in the upper right portion of the panel 80. When the mode select key 83, adjoining the LEDs 84, is pressed once, the LED 84*a* turns on to indicate a sort mode in which printings resulting from a plurality of pages of documents are sorted to the bins 51 in order of page. When the key 83 is pressed twice, the LED 84*b* turns on to indicate a sort and staple mode in which the printings dealt with in the sort mode are automatically stapled. When the key 83 is pressed three times, the LED 84*c* turns on to indicate a so-called continuous mode in which a plurality of printings resulting from a single document image are continuously distributed one by one to each bins 51. Further, when the key 83 is pressed four times, the LED 84*d* turns on to indicate a so-called group mode in which printings are grouped in the same manner as in the continuous mode. In this sense, the key 83 plays the role of sort mode setting means, sort and staple mode setting means, continuous mode setting means, and group mode setting means. When the key 83 is not pressed at the beginning of operation of the printer 1, a non-sort mode is automatically set up.

When the speed up key 78 or the speed down key 79 is pressed, the speed indicator 77 indicates a moving speed of any one of seven different levels 1–7. "Level 4" indicated by hatching is representative of a standard speed and is automatically set up when neither the key 78 nor the key 79 is pressed.

The transport speed set key 96 plays the role of the paper type setting means for starting the paper transport speed set mode and functions as the paper type setting means for setting the type of the papers P, including thickness and quality, as stated previously in addition, the paper type setting means may be implemented in an SP (Serviceman Program) mode in which various keys on the panel 80 are sequentially pressed to start the paper transport speed set mode. For example, to start this mode in the SP mode, a serviceman sequentially presses the mode clear key 94, clear key 95, continuous print key 87 and enter key 92 in this order to start the SP mode, then operates the numeral keys 81 to input a numerical value corresponding to a number assigned to the paper transport speed set mode, then presses the enter key 92 to start the speed set mode again operates the keys 81 to input any of the paper type data code numbers listed in Table 2, and then passes the enter key 92. Let the following description concentrate on the paper type setting means implemented by the transport speed set key 96 and numeral keys 81 which will simplify the construction as well as the description.

Figure 4:
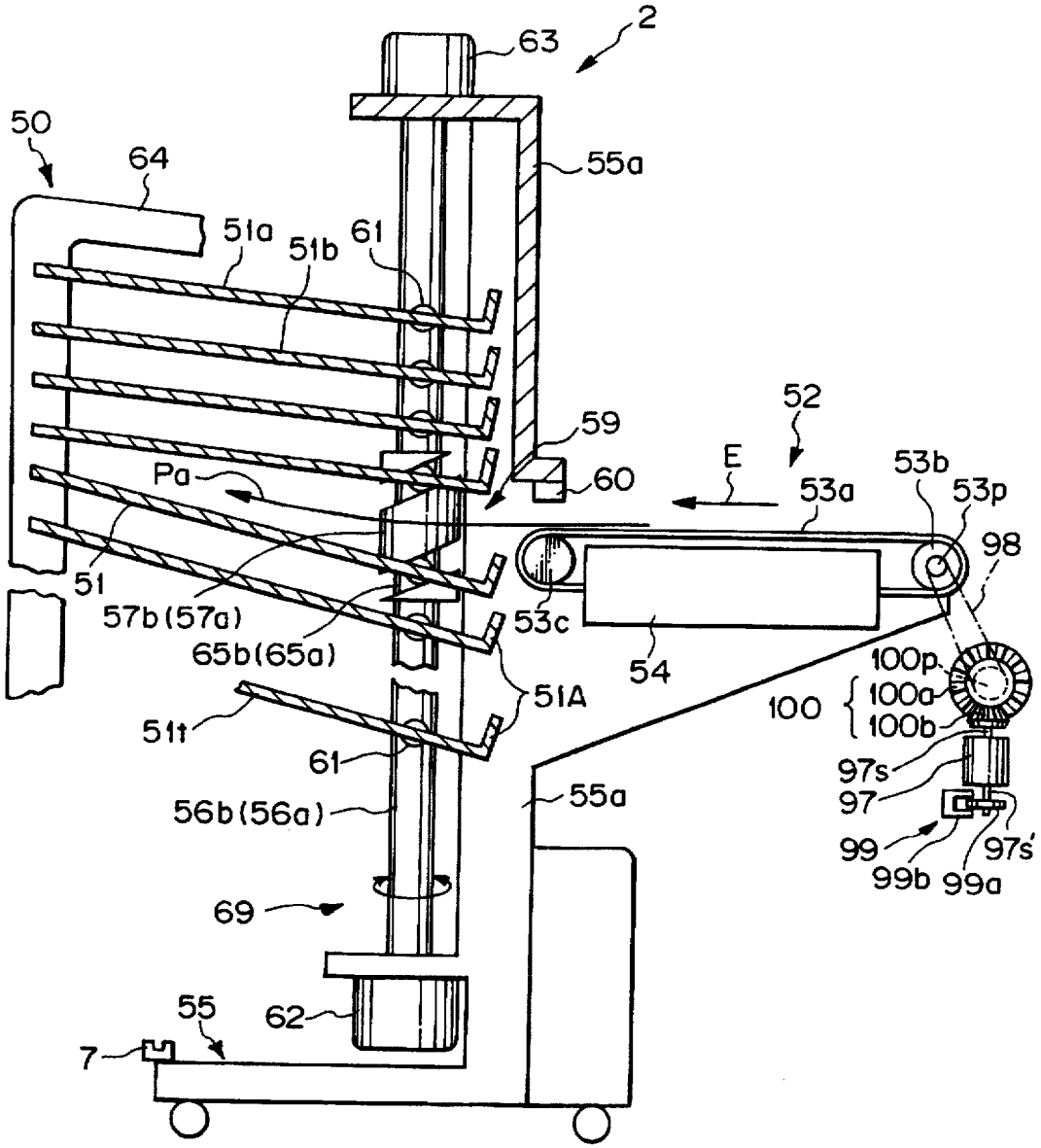
FIG. 4 is an enlarged vertical section of the embodiment.

As shown FIGS. 3 and 4, the sorter 2 has moving means 69 for moving the bin unit 50 up and down, in addition to the intermediate transport device 52 and bin unit 50. The transport device 52 has a transport motor 97 affixed to stationary member. A device roller pulley 53*p* and a bevel gear pulley 100*p* are rotatably supported by the stationary member. A timing belt 98 is passed over the pulleys 53*p* and 100*p*, as indicated by a dash-and-dot line in FIG. 4. A drive roller 53*b* is connected to the transport motor 97 by the timing belt 98 and a pair of bevel gears 100*a* and 100*b*. Each of endless belts 53*a* is formed with a number of openings, not shown, and passed over the drive roller 53*b* and a driven roller 53*c*. A suction unit 54 includes a fan and sucks air from between the opposite runs of the belts 53*a* for thereby retaining the paper or printing Pa on the belts 53*a*. An encoder 99 produces an output representative of the rotation speed of the motor 97. The bevel gear 100*a* is affixed to one end of the bevel gear pulley 100*p* while the bevel gear 100*b* is affixed to the output shaft 97*s* of the motor 97.

The encoder 99 is, for example, a conventional optical rotary encoder having a slitted disk 99*a* and a photointerrupter 99*b*. The disk 99*a* is affixed to the other output shaft 97*s'* of the motor 97. The photointerrupter 99*b* has a light source and a light-sensitive element sandwiching the disk 99*a*. The encoder, or motor speed sensor as referred to hereinafter, 99 may alternatively be implemented by a magnetic encoder, if desired.

The paper transport speed of the belts 53*a* is substantially the safe as the speed at which the printing section 27 prints an image on the paper P and the speed at which the belts 18*c* of the paper discharge section 18 convey a printing. The paper transport speed of the belts 53*a* is so selected as to minimize the projection a of the leading edge portion of the paper Pa from the bin 51 (see FIG. 1) and to obviate the projection b of the trailing edge portion of the same (see FIG. 2).

Figure 5:
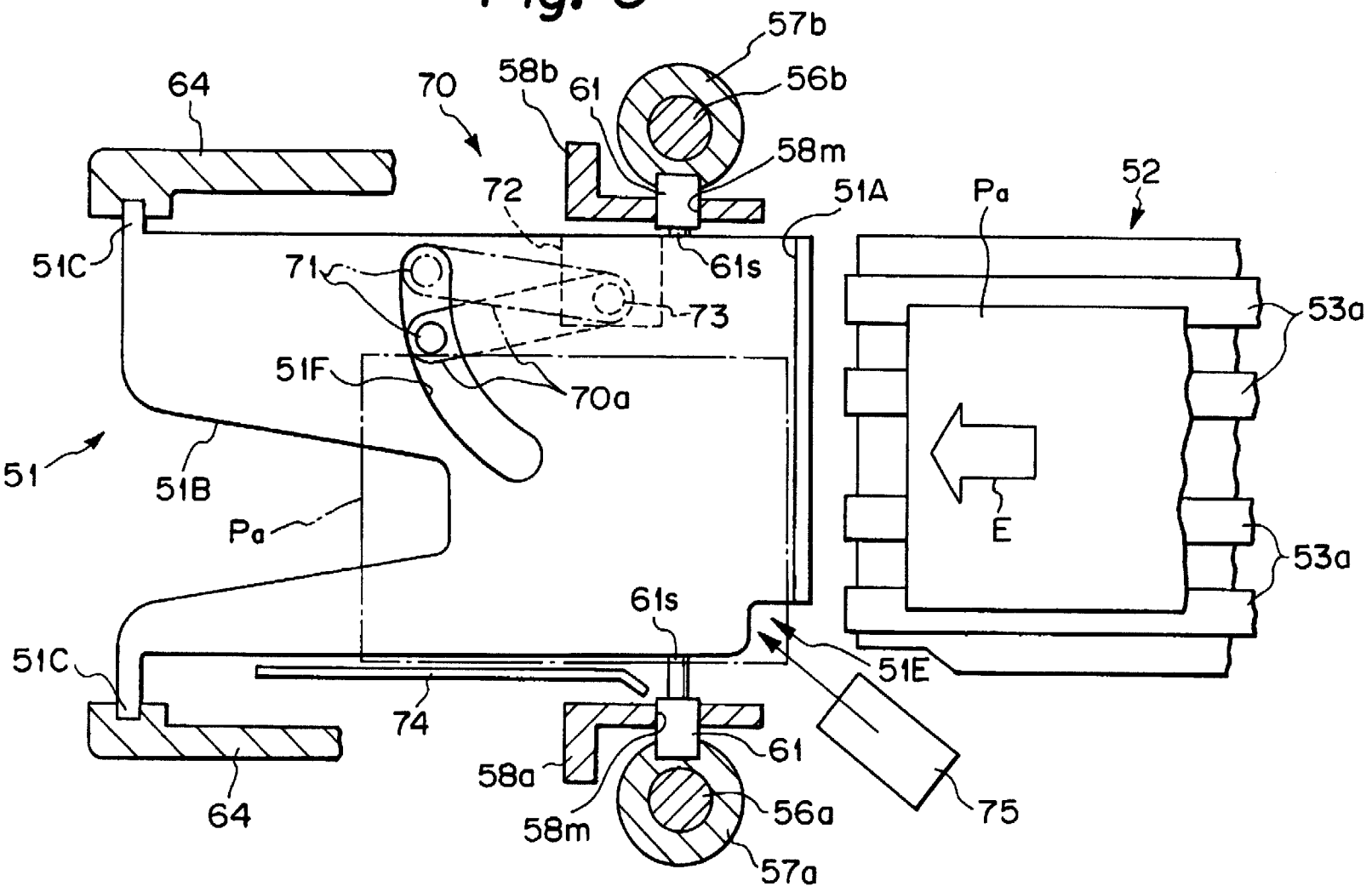
FIG. 5 is an enlarged horizontal section of a bin unit included in the embodiment, and arrangements surrounding it.
Figure 6:
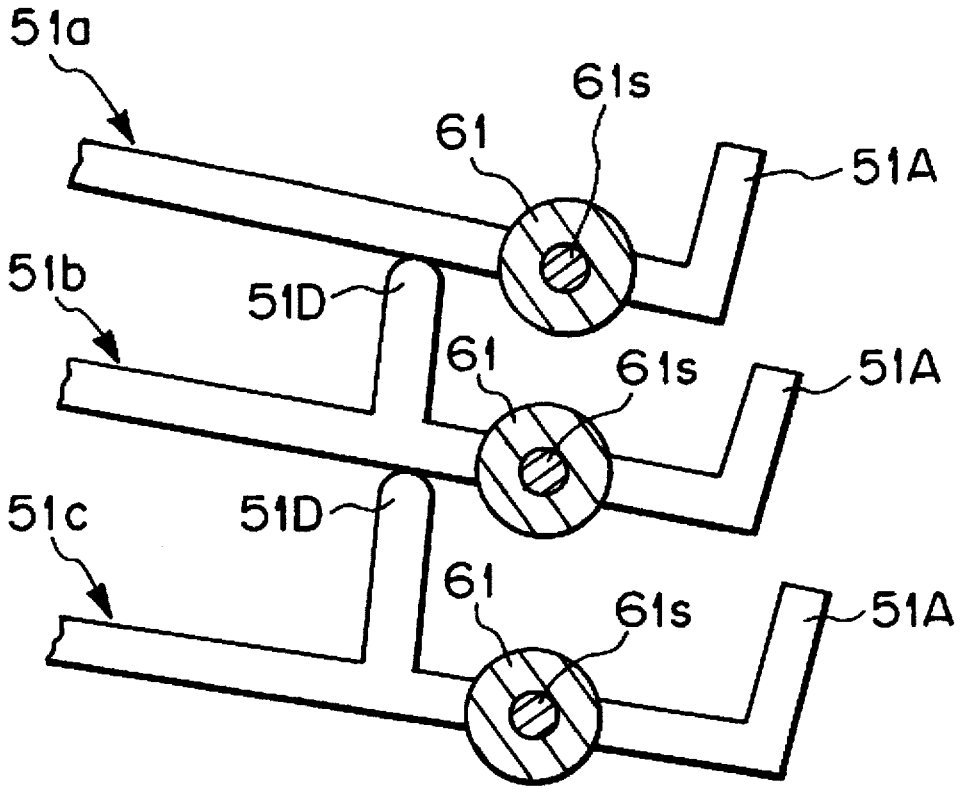
FIG. 6 is an enlarged sectional side elevation showing part of a bin arrangement.

As shown in FIGS. 4–6, the bias 51 are arranged in the vertical direction at predetermined intervals and are identical in configuration. A pair of guide rails 58*a* and 58*b* guide one end portion or paper inlet side of the bins 51 in the vertical direction. A bin unit frame 64 rotatably supports the other end portions of the bins 51 and is movable up and down together with the bins 51 when driven by the moving means 69.

Each bin 51 is implemented as a substantially flat plate and has a rear stop 51A and pin-like lugs 51C molded integrally therewith. The rear stop 51A stands upright from one end of the bin 51 to stop the trailing edge or the paper Pa. The lugs 51C are positioned at opposite sides of the other end of the bin 51. Stubs 61*s* are affixed to opposite sides of the end of the bin 51 adjoining the rear stop 51A. Rollers 61 are respectively rotatably mounted on the stubs 61*s*. Projections or stops 51D are also molded integrally with the bin 51 and positioned at opposite sides adjoining the stubs 61*s*. The stops 51D define a predetermined distance between the bin 51 and the overlying bin 51. The other end of the bin 51 adjoining the lugs 51C is removed in the form of a letter V to form a paper take-out portion 51B. A notch 51B is formed at one end of one side of the bin 51 to prevent the bin 51 from interfering with a stapler unit which will be described. A jogger, which will be described also, is movably received in slots 51F formed in the bin 51. As shown in FIGS. 4 and 6, the bin 51 is inclined downward from the left to the right. Hence, the paper Pa driven into the bin 51 in the direction E is slightly returned to the right until it abuts against the rear stop 51A. As shown in FIG. 5, channels 58*m* are respectively formed in the guide rails 58*a* and 58*b* and respectively guide the rollers 61 of the bin 51. In the illustrative embodiment, the bin unit 50 has twenty bins, i.e., the uppermost bin 51*a* to the lowermost bin 51*t*.

It is to be noted that part of the twenty bins 51 is not shown in FIGS. 3 and 4, the stops 51D and guide rails 58*a* and 58*b* are not shown in FIG. 4, the stops 51D are not shown in FIG. 5, and the guide rails 58*a* and 58*b* and shafts 56*a* and 56*b*, which will be described, are not shown in FIG. 6 for the sake of clarity of illustration.

As shown in FIGS. 4 and 5, the moving means 69 includes the above-mentioned shafts 56*a* and 56*b* positioned outwardly of the guide rails 58*a* and 58*b*. The shafts 56*a* and 56*b* are affixed to pan of a base 55 at a predetermined distance from each other. Lead cams 57*a* and 57*b* are respectively affixed to substantially the intermediate points of the shafts 56*a* and 56*b*. A pulley, not shown, is affixed to the bottom of each of the shafts 56*a* and 56*b*. A timing belt, not shown, is passed over the pulleys of the shafts 56*a* and 56*b*. A motor 62 is drivably connected to one of the pulleys by a belt, not shown.

The lead cams 57*a* and 57*b* are formed with helical grooves 65*a* and 65*b*, respectively. The rollers 61 of the bin 51 are loosely received in the helical grooves 65*a* and 65*b*, respectively. As shown in FIG. 4, the lead cams 57*a* and 57*b* are located to face a paper inlet 59 which receives the paper or printing Pa coming out of the intermediate transport device 52. When the motor 62 is driven in a predetermined direction, e.g., in the forward direction, the lead cams 57*a* and 57*b* are rotated via the pulleys, belt and shafts 56*a* and 56*b*. As a result, the rollers 61 move upward (or downward if the motor 62 is driven in the reverse direction) along the grooves 65*a* and 65*b* while being surely guided by the rails 58*a* and 58*b*. Hence, nearby bins 51 are sequentially moved away from each other at the paper inlet 59 on the basis of the pitch of the grooves 65*a* and 65*b*. The guide rails 58*a* and 58*b*, positioned inwardly of the lead cams 57*a* and 57*b*, are configured such that the rollers 61 moving upward (or downward) along the grooves 65*a* and 65*b* are sequentially forced upward (or downward) into the rails 58*a* and 58*b*, thereby raising (or towering) the bin unit 50. In this manner, the torque of the motor 62 is transmitted to the lead cams 57*a* and 57*b*, so that the bins 51 are raised or lowered stepwise at the paper inlet 59.

As shown in FIG. 5, the sorter 2 further includes a jogger mechanism 70 and a stapler unit mechanism 75. The jogger mechanism 70 positions the papers Pa distributed to the bins 51. The stapler unit mechanism 75 sequentially staples the stacks of papers Pa sorted to the bins 51. An abutment plate 74 faces the jogger mechanism 70 with the intermediary of the bins 51. The mechanisms 70 and 75 and abutment plate 74 are mounted on the base 55 and not movable together with the bin unit 50.

In the jogger mechanism 70, the previously mentioned jogger 71 is implemented as a single upright rod extending from a member included in the bin unit 50. The jogger 71 is pivotally moved back and forth about a shaft 73 by a pulse motor 72. An arm 70*a* connects the jogger 71 to the shaft 73 and receives the output torque of the pulse motor 72. More specifically, when the paper Pa coming out of the transport device 52 arrives at a position above the bin 51, the pulse motor 72 is energized at a predetermined timing. As a result, the jogger 71 is pivotally moved counterclockwise about the shaft 73 and abuts against the side edge of the paper Pa. As a result, the jogger 71 urges the paper Pa against the abutment plate 74. The paper Pa is, therefore, accurately located at a predetermined position on the bin 51, as indicated by a dash-and-dot line in FIG. 5.

The stapler unit mechanism 75 is operated in a conventional manner, as will be outlined hereinafter. When the sort and staple mode is selected or when a manual staple key, not shown, is pressed, the stapler unit, not shown, is moved forward by a drive source, not shown, in the direction indicated by an arrow in FIG. 5. At the same time, the bin unit 50 is sequentially raised or lowered. In this condition, the stapler unit sequentially drives staples into the papers Pa stacked on each bin 51.

The jogger mechanism 70 and stapler unit mechanism 75 are conventional and may be constructed as taught in, for example, Japanese Patent Laid-Open Publication No. 2-56367.

As shown in FIG. 4, an upright post 55*a* extends from the base 55. The previously mentioned paper inlet 59 is formed in substantially the intermediate portion of the post 55*a* in the vertical direction. A paper sensor 60 is mounted on a predetermined portion of the post 55*a* above the paper inlet 59 and determines whether or not a paper Pa has moved away from the paper inlet 59. For the sensor 60, use may be made of a reflection type photosensor having a light emitting element and a light-sensitive element, or a photointerrupter type sensor. The shafts 56*a* and 56*b* are rotatably supported by the post 55*a* at upper ends thereof. An encoder 63 is mounted on the end of the shaft 56*b* to sense the angle and speed of rotation of the shafts 56*a* and 56*b*. The encoder like the previously stated encoder 99, may be implemented by an optical rotary encoder. The encoder, or bin unit speed sensor as referred to hereinafter, 63 may alternatively be implemented by a magnetic encoder, if desired.

The paper sensor 60 and bin unit speed sensor 63 are electrically connected to a sorter controller 4 which will be described with reference to FIG. 11. Every time a paper Pa moves away from the paper inlet 59, the paper sensor 60 senses it. The resulting output of the sensor 60 is sent to a CPU (Central Processing Unit) 120, FIG. 11, included in the sorter controller 4. In response, the CPU or sorter CPU 120 controllably drives the motor 62 such that the lead cams 57*a* and 57*b* make one rotation every time one paper Pa moves away from the paper inlet 59. As a result, the bins 51 is raised (or lowered) one step at a time.

As shown in FIG. 4, a bin unit home position sensor 7 is located at a predetermined position on the base 55 and senses the bin unit 50 brought to its lowermost position or home position, i.e., the position where the top bin 51*a* faces the paper inlet 59. A lug, not shown, is provided on the bottom of the frame 64 of the bin unit 50. The output of the sensor 7 goes high when the sensor 7 senses the lug of the frame 64. While the sensor 7 is comprised of a photointerrupter type sensor having a light emitting element and a light-sensitive element, it may, of course, be replaced with a reflection type photosensor or a microswitch.

The lead cam type sorter moving mechanism shown and described may be replaced with a mechanism disclosed in, for example, Japanese Patent Laid-Open Publication No. 61-136865 or Japanese Patent Publication No. 3-6104. Further, the means for moving the bin unit 50 up and down and using the lead cams may be replaced with means of the type using a chain sprocket or a wire and pulley device.

A reference will be made to FIG. 11 for describing a control system for controlling the operation of the printer 1 and sorter 2. It is to be noted that blocks indicated by dashed lines are not used in this embodiment.

As shown, the system includes a printer controller 3 and the previously mentioned sorter controller, or transport speed control means, 4. The printer controller 3 and sorting controller 4 are electrically connected to each other and interchange command signals, ON/OFF signals and data signals. The printer controller 3 is a microcomputer having a printer CPU 11O, an I/O (Input/Output) port, not shown, a ROM (Read Only Memory) 111, and a RAM (Random Access Memory) 112 connected together by a signal bus, not shown. Likewise, the sorter controller 4 is a microcomputer having a ROM 121, a RAM 122, an I/O port, not shown, and the previously mentioned sorer CPU 120 connected together by a signal bus, not shown. The controllers 3 and 4 are respectively provided on a board, not shown, disposed in the cabinet 10 of the printer 1 and a board, not shown, disposed in the base 55 of the sorer 2. The controller 4 may be accommodated in the cabinet 10 together with the controller 3, if desired.

The printer controller 3 is electrically connected to the keys and displays 90 and 91 of the panel 80, size sensors 38, and size sensor 39, and interchanges command signals and/or ON/OFF sights and data signals therewith. Further, the controller 3 is electrically connected to an ADF and reading device 113 constituting the ADF 29 and reading section 30, a master make and feed mechanism 114 constituting the master making section 21 and master feeding section, a master discharge mechanism 115 constituting the master discharge section 19, a paper feed mechanism 116 constituting the paper feed section 28, a print mechanism 117 constituting the printing section 27, and a paper discharge mechanism 118 constituting the paper discharge section 18 via respective drivers, not shown, and interchanges command signals an/or ON/Off signals and data signals therewith. In this, condition, the controller 3 controls the starts and stops of operation of the various constituents of the printer 1 as well as their timings.

Data signals and ON/OFF signals from the numeral keys 81, print start key 82, mode select key 83, master start key 85, paper size set key 86, continuous print key 87, stop key 89, enter key 92, mode clear key 94, clear key 95, transport speed set key 96, speed up key 78, and speed down key 79 are sent to the printer controller 3. On receiving a paper transport speed set mode signal from the key 96, the controller 3 starts a paper transport speed set mode and, at the same time, transfers to the sorter controller 4 the speed set mode signal and a paper type data signal representative of a paper type data code number entered on the numeral keys 81. At this instant, the display 90 displays the contents of the speed set mode and the contents of the paper type data input to the controller 3.

In response to a mode signal from the mode select key 83, the controller 3 sends a signal for turning on one of the LEDs 84 to a power source driver, not shown, assigned to the LEDs 84, while transferring the mode signal to the sorter controller 4. On receiving a speed set signal from the speed up key 78 or the speed down key 79, the controller 3 sends a signal for turning on one of the LEDs of the speed indicator 77 to a power source driver, not shown, assigned to the indicator 77, while transferring the speed set signal to the sorter controller 4. When the controller 3 receives from the controller 4 a signal output from a multi-sorter sensor 8 and representative of the serial connection of two or more sorters, it sends a signal for turning on the LED 88 to a power source driver, not shown, assigned thereto.

The outputs of the size sensors 38 and 39 are sent to the printer controller 3. The controller 3 transfers such sensor outputs to the sorter controller 4. The size signals or size data from the size sensors 38 and 39 are also used to cause the controller 3 to inhibit the thermal head 22 from perforating the stencil except for the print area of a paper. This successfully protects the press roller 17 from smears and implements any other desired function based on a paper size.

In the printer controller 3, the ROM 111 stores a program relating to the starts, stops and timings of each device or drive mechanism, as well as necessary data. The RAM 112 is used to store the result of computation performed by the printer CPU 110 for a moment, and to store data signals and ON/OFF signals received from the keys, as n ended. Further, the ROM 111 stores a program relating to the control over the moving speed of the bin unit 50 and speed data, as will be described specifically later.

The sorter controller 4 is electrically connected to the paper sensor 60, bin unit speed sensor 63, and bin unit home position sensor 7 as well as to the printer controller 3, and receives ON/OFF signals and data signals therefrom. Also, the sorter controller 4 is electrically connected to the bin unit motor 62 and the motors of the intermediate transport device 52, jogger mechanism 70, and stapler unit mechanism 75, and sends command signals thereto in response to the above input signals. The sorter controller 4 controls the entire system relating to the starts, stops and other operations of the sorter 2. The sorter controller 4, changes the paper transport speed of the transport device 52 to one matching the outputs of the size sensors 38 and 39, the outputs of the speed set key 96 and numeral keys 81, and the data signal representative of the type of the papers Pa which are transferred from the printer controller 3. Further, the sorter controller 4 plays the role of means for changing the previously mentioned moving speed of the bin unit 50 in response to a speed set signal also transferred from the printer controller 3.

In the sorter controller 4, the ROM 121 stores a program relating to the starts, stops and timings of the sorter 2 for to executing various modes, a program relating to various commands for the starts anti stops of printing operation, including paper feed, printing and paper discharge, as well as other operations and their timings, and necessary data. More specifically, the ROM 121 stores the contents of Table 3 shown below, i.e., a table listing optimal paper transport speeds capable of obviating jams and other troubles by preventing at least the trailing edge portion of the paper from being left at the outside of the bin 51, and on the basis of paper size data and paper type data as parameters determined by experiments beforehand. Table 3 is used to enhance, among others, the accurate positioning of the papers P on the bin 51. In Table 3, paper size data and standard paper transport speeds corresponding thereto (mm/sec) are listed in rows, while paper type data based on the types of papers (represented by code numbers) and their general types are listed in columns. In the matrix determined by the paper sizes and paper type data, the positive values and the negative values are respectively representative of ratios (%) by which the transport speed should be increased relative to the standard speed, and ratios by which they should be decreased relative to the same.

TABLE 3

| Paper Type Data (Code No.) | Paper Size Data Transport Speed (mm/s) (standard: 0%) | A3 End 1140 | B4 End 1070 | A4 End 1000 | A4 Side 870 | B5 End 940 | B5 Side 840 | A5 End 900 | post card End 940 | DLT End 1140 | LG End 1070 | LT End 960 | LT Side 870 | HLT End 840 | Irregular Size 1140 |
|---|---|---|---|---|---|---|---|---|---|---|---|---|---|---|---|
| 15 | spare | 0 | 0 | 0 | 0 | 0 | 0 | 0 | 0 | 0 | 0 | 0 | 0 | 0 | 0 |
| 14 | copy paper | 10 | 5 | 5 | 0 | 0 | 0 | 0 | 0 | 0 | 0 | 0 | 0 | 0 | 0 |
| 13 | recycled | 0 | 0 | 10 | 0 | 0 | 0 | 0 | 0 | 0 | 0 | 0 | 0 | 0 | 0 |
| 12 | paper | 5 | 0 | 5 | 0 | 0 | 0 | 0 | 0 | 0 | 0 | 0 | 0 | 0 | 0 |
| 11 | thin paper | 0 | 0 | 0 | 0 | 5 | 0 | 0 | 0 | 0 | 0 | 0 | 0 | 0 | 0 |
| 10 | standard paper | 0 | 0 | 0 | 0 | 0 | 0 | 0 | 0 | 0 | 0 | 0 | 0 | 0 | 0 |
| 9 | high paper with | 30 | 30 | 30 | 30 | 30 | 30 | 30 | 30 | 30 | 30 | 30 | 30 | 30 | 30 |
| 8 | ↑ high | 25 | 25 | 25 | 25 | 25 | 25 | 25 | 25 | 25 | 25 | 25 | 25 | 25 | 25 |
| 7 | \| resistance | 20 | 20 | 20 | 20 | 20 | 20 | 20 | 20 | 20 | 20 | 20 | 20 | 20 | 20 |
| 6 | \| | 15 | 15 | 15 | 15 | 15 | 15 | 15 | 15 | 15 | 15 | 15 | 15 | 15 | 15 |
| 5 | \| | 10 | 10 | 10 | 10 | 10 | 10 | 10 | 10 | 10 | 10 | 10 | 10 | 10 | 10 |
| 4 | \| | 5 | 5 | 5 | 5 | 5 | 5 | 5 | 5 | 5 | 5 | 5 | 5 | 5 | 5 |
| 3 | \| paper with | −5 | −5 | −5 | −5 | −5 | −5 | −5 | −5 | −5 | −5 | −5 | −5 | −5 | −5 |
| 2 | \| low | −10 | −10 | −10 | −10 | −10 | −10 | −10 | −10 | −10 | −10 | −10 | −10 | −10 | −10 |
| 1 | ↓ resistance | −15 | −15 | −15 | −15 | −15 | −15 | −15 | −15 | −15 | −15 | −15 | −15 | −15 | −15 |
| 0 | low | −20 | −20 | −20 | −20 | −20 | −20 | −20 | −20 | −20 | −20 | −20 | −20 | −20 | −20 |

As Table 3 indicates, for the papers P of relatively large sizes or subjected to relatively high resistances, higher standard speeds are selected, and the transport speeds are increased by greater ratios relative to the standard speeds. For the papers P of irregular sizes, e.g., sizes indicated by "*" in Table 1, the standard speed of 1140 mm/sec assigned to A3 endways and DLT and highest in Table 3 is selected with priority given to at least the full accommodation of the tailing edge portion of the paper in the bin 51.

In the sorter controller 4, the RAM 122 is used to store the result of computation by the CPU 120 for a moment and to store data signals and ON/OFF signals, as needed.

The sorter controller 4 selects an adequate paper transport speed on the data table (Table 3) on the basis of the paper transport speed set mode signal, paper size data signal, and paper type data signal received from the printer controller 3. The controller 4 sends a command signal, representative of the adequate paper transport speed to the transport motor 97 via a motor drive 97A. As a result, the transport motor 97 is rotated at a particular speed for driving the drive roller **53*b*, driven roller 53*c* and belts 53*a* of the intermediate transport device 52 at an adequate speed. The encoder or motor speed sensor 99 senses the rotation speed of the motor 97 and sends a data signal representative of the speed to the sorter controller 4 via a pulse detector 125. In response, the CPU 120 transforms the data signal to a signal indicative of the current rotation speed of the motor 97, i.e., the transport speed of the belts 53*a*, and produces an output signal indicative of a difference between it and the adequate transport speed. If the current transport speed is low, the CPU 120** increases it; if otherwise, it decreases it. Consequently, the paper or printing Pa is transported at the adequate speed without fail.

On the other hand, the bin unit speed sensor 63 sends to the sorter controller 4 an angular speed signal representative of the angular speed of the shafts **56*a* and 56*b* of the moving means 69. The bin unit home position sensor 7 sends to the sorter controller 4 a bin arrival signal representative of the arrival of the bin unit 50 at its home position. When the bin arrival signal is sent to the printer controller 3, the printer CPU 110 compares the angular speed with the speed data stored in the ROM 111, and then controls the rotation of the motor 62 such that the speed of the bin unit 50** moving upward or downward toward the home position coincides with particular speed data.

More specifically, the sorter controller 4 has the following functions. When the continue mode or the group mode is selected, the controller 4 moves the bin unit 50 at a dashed continue mode (group mode) speed lower than a sort mode speed assigned to the sort mode. When the sort and staple mode is selected, the controller 4 moves the bin unit 50 at a sort and staple mode speed higher than the sort mode speed. When the papers are of postcard size as determined by the size sensors 38 and if the continue mode or the group mode is selected, the controller 4 moves the bin unit 50 at a postcard speed even lower than the above desired continue mode (group mode) speed. When the postcard size is selected on the paper size set key 86 and if the continue mode or the group mode is selected, the controller A moves the bin unit 50 at the postcard speed. Further, when a plurality of sorters are serially connected to the printer 1 and if the continue mode or the group mode is selected, the controller 4 moves the bin unit 50 at a multi-sorter speed higher than the above desired continue mode (group mode) speed.

Specific numerical values (times required) for the sorter controller 4 to change the moving speed of the bin unit 50 are listed below on a mode basis:

| | Level 7–Level 1 |
|---|---|
| (1) Sort mode speed | 20 sec–40 sec |
| (2) Continue (group) mode speed | 60 sec–120 sec |
| (3) Sort & staple mode speed | 10 sec–20 sec |
| (4) Postcard speed | 120 sec–180 sec |
| (5) Multi-sorter speed | 30 sec–60 sec |

The range of multi-sorter speeds is selected to be higher than the range of continue mode (group mode) speeds and is shifted to the lower speed side than the range of sort mode speeds.

To increase or decrease the moving speed of the bin unit 50, the sorter controller 4 may shift the entire range of levels 7–1 or may increase or decrease the level (from the standard level 4) in the same range as the sort mode speeds or continue mode (group mode) speeds. For the latter scheme, the speeds may range from 10 seconds to 180 seconds by way of example.

The operation of the printer 1 and sorter 2 connected together will be described hereinafter.

First, a sort mode operation will be described with reference to FIGS. 3–11. Assume that the tray 14 is loaded with standard papers P of size A4 and positioned endways, and that the operator desires to produce twenty printings with each of five pages of documents by using the standard papers P of the above size and orientation and represented by the paper type data code No. 10. Then, the operator sets the five documents on the tray 29*a* of the ADF 29, and then presses the mode select key 83 once to select the sort mode. In response, the LED 84*a* assigned to the sort mode turns on. Usually, the non-sort mode is set up, as stated earlier. When the operator operates the numeral keys 81 to input the desired number of copies "20", the value "20" appears on the display 91. Subsequently, the operator presses the speed set key 96 to start the paper transport speed set mode, and then inputs the code number "10" on the numeral keys 81. In response, a message "Type of papers: 10 . . . standard paper" appears on the display 90. In this case, it is assumed that the operator uses the printer 1 and sorter 2 in an office, and that the printing operation is not urgent of course, the sort mode does not include automatic stapling. Hence, the operator presses the speed down key 79 to select a bin unit moving speed of level "2" lower than the standard speed or level "4".

When the operator presses the master start key 85, both the master discharge mechanism 115 included in the master discharge section 19 and the DC motor M11 included in the print mechanism 117 are energized. The motor M11 drives the drum 11, carrying the used master thereon, counterclockwise. The roller pair 19*b* and 19*c* removes the used master from the drum 11. The used master is conveyed by the roller pair 19*b* and 19*c* to the waste master box 19*a*. The drum 11 is further rotated and then brought to a stop at the position shown in FIG. 3. Then, the master clamper 25 is rotated clockwise or opened by actuating means, not shown. In this condition, the drum 11 waits for a new master.

In parallel with the above master discharging procedure, a master making procedure is executed, as follows. The ADF and reading device 113 is operated to read the first document fed by the ADF 29, thereby producing an image signal. In the mater making section 21, the master make and feed mechanism 114 is driven to cause the thermal head 22 to selectively generate heat in accordance with the image signal. As a result, the head 22 forms a perforation pattern representative of the document image in the stencil S. The perforated stencil or master S is conveyed to the open master clamper 25 by the roller pair 24*a* and 24*b*. After the leading edge of the master S has been clamped by the clamper 25, the master S is wrapped around the drum 11. When the stencil S is conveyed in a predetermined amount, as determined in terms of the number of steps of the stepping motor, not shown, for driving the platen roller 23, the rotation of the roller 23 is stopped. Then, the trailing edge of the perforated part of the stencil S is cut by the cutter 26.

Subsequently, the paper feed mechanism 116, print mechanism 117 and paper discharge mechanism 118 are adequately driven. At this instant, the bin unit 50 is located at its lowermost position or home position; the top bin faces the paper inlet 59. The pick-up roller 15 feeds the uppermost paper P from the tray 14 to the registration roller pair 16*a* and 16*b*, The roller pair 16*a* and 16*b* once stops the paper P and again drives it to between the drum 11 and the press roller 17 in synchronism with the rotation of the drum 11. Then, the press roller 17 is raised to press the paper against the master S wrapped around the drum 11 which is rotating clockwise. As a result, the ink is transferred to the front of the paper P via the porous portion of the drum 11 and the perforation pattern of the master S, thereby producing a so-called trial printing Pa.

The trial printing Pa produced by the above procedure is separated from the drum 11 by the separator 18A. The belts 18*c* convey the printing Pa to the intermediate transport device 52 while retaining it thereon due to the suction of the fan 18*d*. In synchronism with the operation of the belts 18*c*, the motor 97 of the transport device 52 is energized. The printing Pa reached the belts 53*a* of the transport device 52 conveyed to the paper inlet 59 while being sucked by the suction unit 54.

The trial printing Pa (usually one) is distributed to the top bin 51*a* of the bin unit 50 that faces the paper inlet 59. The trial printing is not counted as one of the desired twenty printings. For the trial printing, the printing and paper transport are each effected at a standard speed for trial printing. On determining that the trig printing is acceptable, the operator presses the print start key 82. In response, the printer 1 produces the first printing which is one of the twenty printings, as follows.

The sorter controller 4 starts the paper transport speed set mode in response to a speed set mode signal received from the printer controller 3. The sorter CPU 120 receives from the printer controller 3 a size data signal representative of "A4 endways" and derived from the output of the size sensor 38*c*, and a paper type data signal representative of the standard papers. In response, the sorter CPU 120 selects a transport speed of 1000 mm/sec (no increase or decrease) on Table 3 and sends a command signal to the motor 97 of the intermediate transport device 52 via the motor driver 97A. As a result, the motor 97 is driven to transport the printing Pa at 1000 mm/sec which is adequate for paper positioning. In the printer 1, print speed setting means, not shown, sets up a particular transport speed such that the mechanisms 116, 117 and 118 operate at a speed equal to or less than the lowest speed in Table 3 or 15% higher than the same at most. This prevents the printing Pa from noticeably warping between the transport device 52 and the paper discharge section 18 of the printer 1.

An arrangement may be made such that the printing speed in the printer 1 is variable in matching relation to the transport speed data, as stated previously. In such an arrangement, the sorter CPU 120 returns the command signal selected on Table 3 to the printer CPU 110. In response, the printer CPU 110 causes the mechanisms 116, 117 and 118 to operate in synchronism with the transport speed of 1000 mm/sec.

By the above procedure, the first printing is produced at the printing speed synchronous to or lower than the paper transport speed in the same manner as the trial printing. The first printing is driven into the first bin 51*a* via the paper inlet 59 at the transport speed adequate for paper positioning.

When the paper sensor 60 determines that the first printing has moved away from the paper inlet 59, the sorter controller 4 drives, in response to the output of the sensor 60, the motor 62 such that the lead cams 57*a* and 57*b* make one rotation. As a result, the bins 51 of the bin unit 50 are moved one step upward. In this condition, the second printing is driven into the second bin 51*b*.

As soon as the twentieth printing is driven into the bottom bin 51*t*, the operation of the printer 1 is interrupted. In the sorter 2, the sorter controller 4 rotates the motor 62 and, therefore, the lead cams 57*a* and 57*b* in the reverse direction. As a result, the bin unit 50 is lowered to its home position. The return of the bin unit 50 is effected at the speed of "level 2" as selected on the speed down key 79. Hence, the bin unit 50 is lowered relatively slowly with a minimum of noise at "level 2" read out of the ROM 111.

While the return of the bin unit 50 is under way, the ADF 29 of the printer 1 feeds the second document to the reading section 30. The second document is read by the reading section 30 and reproduced in the stencil S. Then, the stencil or master S is wrapped around the drum 11. When the bin unit home position sensor 7, senses the unit 50 lowered to its home position, the printer controller 3 causes, in response to the output of the sensor 7, the printer 1 to start printing the image of the second document on a paper. After the trial printing with the second document, the actual printing is driven into the top bin 51*a*. Thereafter, the bin unit 50 is sequentially raised, as stated earlier.

When the bin unit 50 has twenty bins 51, as in the embodiment, and the sort mode is selected, the returning speed of the bin unit 50 to the home position can be selected from a range of from 20 seconds to 40 seconds in terms of time required. Hence, the the bin unit 50 is returned at a rate of one bin per 1.0 second to 2.0 seconds.

A sort and staple mode operation will be described, also assuming the specific conditions stated in relation to the sort mode operation. The following description will concentrate on part of the sort and staple mode operation different from the sort mode operation. When the operator presses the mode select key 83 twice, the LED 84*b* assigned to the sort and staple mode turns on. Then, the sorter controller 4 sends a command signal also to the jogger mechanism 70. Every time a printing is driven into each bin 51, the pulse motor 72 of the mechanism 70 drives the jogger 71 back and forth in the slots 51F of each bin 51, thereby positioning the printing. After a set of five printings have been stacked on each of the twenty bins 51, the stapler unit mechanism 75, i.e., stapler unit starts stapling them. Specifically, the stapler unit is moved toward the printings stacked on the bottom bin 51*t*, staples them, and then returns. After the bin unit 50 has been one step downward, the stapler unit staples the printings stacked on the second bin 51*s* from the bottom in the same manner. The stapler unit repeats this operation twenty times.

In the sort and ample mode, the sorter controller 4 automatically sets up the highest speed of "level 7" for the return of the bin unit 50 to the home position via the motor 62. The moving speed is, therefore, higher than the standard speed assigned to the sort mode. Specifically, because the positioning of printings on each bin 51 is of primary importance in the event of stapling, the moving speed is increased in order to enhance the positioning automatically by taking advantage of the vibration.

However, for standard papers and an image having a minimum of solid image area, priority is given to the level of the moving speed selected on the moving speed setting means. That is, the opener can press the speed down key 79 to select, for example, "level 6" or "level 5" in place of "level 7". Alternatively, a moving speed higher than in the sort mode may be automatically set up in the sort and staple mode. For example, the moving speed of 20 seconds to 40 seconds may be automatically increased to 10 seconds to 20 seconds in terms of time required.

A continue mode operation is as follows. This mode is used to produce clean printings with standard papers, e.g., fine quality papers or PPC (Plain Paper Copier) papers which are apt to suffer from smears on the rear thereof. Assume that the operator desires to produce fifty printings with PPC papers of size A4 (in Table 2, papers P represented by the paper type data code No. 14 assigned to Ricoh PPC TYPE 6200 available from Ricoh Co. Ltd.) and positioned endways.

First, the operator sets a single document, not shown, on the tray 29*a* of the ADF 29, and then presses the mode select key 83 three times. In response, the LED 84*c* assigned to the continue mode turns on. As the operator inputs "50" which is the desired number of printings on the numeral keys 81, "50" appears on the display 91. Subsequently, the operator presses the speed set key 96 to start the transport speed set mode and inputs the code number "14" on the numeral keys 81. In response, a message "Type of papers: 14 . . . copy papers" appears on the display 90. Thereafter, the operator presses the speed down key 79 to select, for example, "level 3". If the operator does not press the key 79, "level 4" which is the standard speed is automatically set up.

When the operator presses the master start key 85, the printer 1 executes the procedure beginning with the step of discharging the used master and ending with the discharging of the trial printing, as in the sort mode. The trial printing is distributed to the top bin 51*a* facing the paper inlet 59. If the trail printing is acceptable, the opener presses the print start key 82. Subsequently, the sorter controller 4 starts the paper transport speed set mode in response to a transport speed set mode signal received from the printer controller 3. At this instant, the printer controller 3 sends to the sorter controller 4 a size data signal representative of "A4 endwise" and derived from the output of the size sensor 38*c*, and a paper type data signal representative of the copy papers. In response, the sorter CPU 120 selects the standard speed of 1000 mm/sec matching the paper type data, then increments it by 5% because copy papers are used, and thereby produces a speed of 1000+1000×0.05=1050 mm/sec. The sorter CPU 120 sends a command signal to the motor 97 via the motor driver 97A such that the transport speed of 1050 mm/see adequate for paper positioning is set up. The printer 1 is operated at a particular speed, as stated earlier. When the printing speed should be controlled in conformity to the paper transport speed, the sorter CPU 120 sends a command signal to the printer CPU 110, as stated earlier. In response, the printer CPU 110 delivers a command signal to the mechanisms 116, 117 and 118 for causing them to operate in synchronism with the paper transport speed of 1050 mm/sec.

The first actual printing is produced in the same manner as the trial printing at the speed synchronous to or lower than the paper transport speed. The first printing is driven into the top bin 51*a* via the intermediate transport device 52 and paper inlet 59 at the adequate transport speed. After the bin unit 50 has been move one step upward, the second printing is distributed to the second bin 51*b*.

When the twentieth printing is distributed to the bottom bin 51*t*, the printing operation of the printer 1 is interrupted. In the sorter 2, the sorter controller 4 causes the motor 62 and, therefore, the lead cams 57*a* and 57*b* to rotate in the reverse direction. As a result, the bin unit 50 is lowered to the home position. In this case, the return of the bin unit 50 to the home position occurs at the speed of "level 3" selected by the operator.

The printer 1 simply waits until the the bin unit 50 returns to the home position, without performing any perforation. When the bin unit home position sensor 7 senses the bin unit 50 brought to the home position, the printer controller 3 causes the printer 1 to start producing the twenty-first printing in response to the output of the sensor 7. The twenty-first printing and successive printings are sequentially driven into the top bin 51*a* and successive bins. When the fortieth printing is received in the bottom bin 51*t*, the printing operation is again interrupted. Then, the remaining ten printings are sequentially produced and distributed to the top bin 51*a* and successive bins.

In the continue mode, it is noteworthy that the moving speed of "level 3" selected by the operator differs from the moving speed in the sort mode. Specifically, the sorter controller 4 automatically lowers the moving speed in the continue mode than in the sort mode. For example, in the continue mode, the speed range corresponding to "level 7" to "level 1" is 60 seconds to 120 seconds in terms of time required. Hence, even when the operator selects the highest speed of "level 7" for the continue mode, the moving speed is only one bin per 3 seconds. This is because priority should be given to time for preventing ink from being transferred from the front of an underlying paper to the rear of an overlying paper rather than to paper positioning, i.e., because the bin unit 50 should be returned to the home position slowly with a minimum of noise. In addition, the continue mode does not include stapling.

A group mode operation to be described is selected when printings should be grouped or classified in the same manner as in the continue mode. This mode operation may also be used to produce clean printings with, for example, fine quality papers or PPC papers which are apt to suffer from smears on the rear thereof. Assume that the operator desires to produce 200 printings with a single document and to divide them into ten classes or groups each having twenty printings. Also, assume that use is made of PPC papers of size A4 (represented by the paper type data code No. 14 assigned to Ricoh PPC TYPE 6200 in Table 2) and positioned endways. First, the operator lays the document on the tray 29*a* of of the ADF 29 and then presses the mode select key 83 four times. In response, the LED 84*d* assigned to the group mode turns on. Subsequently, the operator inputs an output condition of "20 (printings)×10 (groups)" on the numeral keys 81, presses the speed set key 96 to start the paper transport speed set mode, and then inputs the code number "14" on the keys 81. In response, a message "Type of papers: 14 . . . copy papers" appears on the display 90. Subsequently, the operator presses the speed down key 79 to select, for example, "level 3". If the key 79 is not operated, the standard "level 4" is automatically set up.

When the operator presses the master start key 85, the printer 1 executes the procedure beginning with the master discharging step and ending with the paper discharging step, as in the sort mode. Assume that the operator determines that the trial printing driven into the top bin 51*a* is acceptable. Then, the operator presses the print start key 82. After the trial printing, in response to a paper transport speed set mode signal received from the printer controller 3, the sorter controller 4 starts the speed set mode and sends a command signal to the motor 97 via the motor driver 97A such that the transport speed of 1050 mm/sec adequate for paper positioning is set up, as in the continue mode. The printer 1 is operated at a particular speed, as stated earlier. When the printing speed should be controlled in conformity to the paper transport speed, the sorter CPU 120 sends a command signal to the printer CPU 110, as stated earlier. In response, the printer CPU 110 delivers a command signal to the mechanisms 116, 117 and 118 for causing them to operate in synchronism with the paper transport speed of 1050 mm/sec.

The first actual priming is produced in the same manner as the trial printing at the speed synchronous to or lower the paper transport speed. The first printing is driven into the top bin 51*aa* a via the intermediate transport device 52 and paper inlet 59 at the adequate transport speed. After the bin unit 50 has been moved by one step upward, the second printing is distributed to the second bin 51*b*.

When the tenth printing is distributed to the tenth bin 51*j*, the printing operation of the printer 1 is interrupted. In the sorter 2, the sorter controller 4 causes the motor 62 and, therefore, the lead cams 57*a* and 57*b* to rotate in the reverse direction. As a result, the bin unit 50 is lowered to the home position. In this case, the return of the bin unit 50 to the home position occurs at the speed of "level 3" selected by the operator.

The printer 1 simply waits until the bin unit 50 returns to the home position, without performing any perforation. When the bin unit home position sensor 7 senses the bin unit 50 brought to the home position, the printer controller 3 causes the printer 1 to start producing the eleventh printing in response to the output of the sensor 7. The eleventh printing and successive printings are sequentially driven into the top bin 51*a* and successive bins. When the twentieth printing is received in the tenth bin 51*j*, the printing operation is again interrupted. Such a procedure is further repeated eighteen times to produce 180 printings. The printing operation ends when twenty printings are fully stacked in each of the top bin 51*a* to the tenth bin 51*j*.

In the group mode, too, the moving speed of "level 3" selected by the operator differs from the moving speed in the sort mode. Specifically, the sorer controller 4 automatically lowers the moving speed in the group mode than in the sort mode. For example, in the group mode, the speed range corresponding to "level 7" to "level 1" is 60 seconds to 120 seconds in terms of time required. Hence, even when the operator selects the highest speed of "level 7" for the group mode, the moving speed is only one bin per 3 seconds. This is because priority should be given to time for preventing ink being transferred from the front of an underlying paper to the rear of an overlying paper rather than to paper positioning, i.e., because the bin unit 150 should be returned to the home position slowly with a minimum of noise. In addition, the group mode does not include stapling.

In the group mode, the bin unit 50 may be controlled by the following alternative scheme. When the tenth printing is driven into the tenth bin 51*j*, not shown, as in the previous procedure, the printing operation of the printer 1 is interrupted for a predetermined period of time, e.g., one equal to the period time necessary for the bin unit 50 to be lowered to the home position as in the continue mode. Subsequently, the printer 1 resumes the printing operation with the result that the eleventh printing is also driven into the tenth bin 51*j*. As the eleventh printing moves away from the paper inlet 59, as determined by the paper sensor 60, the sorter controller 4 controls, in response to the output of the sensor 60, the motor 62 such that the lead cams 57*a* and 57*b* make one rotation in the reverse direction. Consequently, the bin unit 50 is moved one step upward. In this condition, the twelfth printing is received in the ninth bin 151*i*, not shown. As soon as the twentieth printing is driven into the top bin 51*a*, the printing operation of the printer 1 is again interrupted for the predetermined period of time. Subsequently, the printer 1 resumes the printing operation, and the resulting twenty-first printing is also driven into the top bin 51*a*. As the twenty-first printing moves away from the paper inlet 59, as also determined by the paper sensor 60, the sorter controller 4 controls the motor 62 such that lead cams 57*a* and 57*b* make one rotation in the same direction as during elevation. As a result, the bin unit 50 is moved one step upward. The above procedure is repeated to produce the remaining printings. The printing operation ends when twenty printings are stacked on each of the first bin 51*a* to the tenth bin 51*j*. A timer, not shown, is included in the printer controller 3 in order to count the predetermined period of time mentioned above.

With the illustrative embodiment, it is also possible to print images on postcards in the continue mode and distribute them to the bins 51 of the bin unit 50, as follows. Let the following description concentrate on the difference between this mode operation and the continue mode operation. Postcards should be strictly protected from the transfer of ink to their rear surfaces. For example, when ink is transferred to the postmark portion or the zip code portion of a postcard, it should be corrected, or the postcard itself should be discarded. Assume that the size sensors 38*a* and 38*d* are turned on show that the papers are of postcard size, and that the continue mode is selected on the mode select key 83. Then, the sorter controller 4 automatically sets up the lowest moving speed of "level 1" lower than the standard "level 4" assigned to the continue mode. Again, the operator may, of course, press the speed up key 78 to select "level 2" lower than "level 4", if desired.

Assume that the paper size is "postcard endways", that the paper type is postcards represented by the paper type data code No. 3 and subjected to small resistance, and that an image should be printed on fifty postcards. As shown in Table 1, the postcard size may be the size of a 100 mm×148 mm postal card. It is to be noted that a trial printing card identical in size with the fifty postal cards stacked on the tray 14 is laid on the top of the stack for trial printing.

First, the operator lays a single document, not shown, for the postal cards on the tray 29*a* of the ADF 29, and then presses the mode select key 83 three times. In response, the LED 84*c* assigned to the continue mode turns on. Subsequently, the operator inputs the desired number of printings "50" on the numeral keys 81. In response, "50" appears on the display 91. Then, the operator presses the speed set key 96 to start the paper transport speed set mode, and inputs the code number "3" on the keys 81. In response, a message "Type of papers: 3 . . . postal cards" appears on the display 90. In this case, the lowest speed of "level 1" lower than the standard "level 4" for the continue mode is automatically set up.

Subsequently, the operator presses the master start key 85. In response, the printer I executes the procedure beginning with the master discharging step and ending with the paper discharging step, as in the continue mode. As a result, the trial printing is driven into the top bin 51*a* of the bin unit 50 facing the paper inlet 59. If the trial printing is acceptable, the operator presses the print start key 82. Subsequently, the sorter controller 4 starts the paper transport speed set mode in response to a transport speed set mode signal received from the printer controller 3. At this instant, the printer controller 3 sends to the sorter controller 4 a size data signal representative of postal cards and derived from the output of the size sensors 38*a* and 38*d*, and a paper type data signal representative of the code number "3". In response, the sorter CPU 120 selects the standard speed of 940 mm/sec matching the paper type data, then decrements it by 5%, and thereby produces a speed of 940–940×0.05=839 mm/sec. The sorter CPU 120 sends a command signal to the motor 97 via the motor driver 97A such that the transport speed of 893 mm/sec adequate for paper positioning is set up. The printer 1 is operated at a particular speed, as stated earlier. When the printing speed should be controlled in conformity to the paper transport speed, the sorter CPU 120 sends a command signal to the printer CPU 110, as stated earlier. In response, the printer CPU 110 delivers a command signal to the mechanisms 116, 117 and 118 for causing them to operate in synchronism with the paper transport speed of 893 mm/sec. This is immediately followed by the operation of the printer 1 and sorter 2 described in relation to the continue mode.

In the event of printing an image on postcards, a lower moving speed than in the continue mode may be automatically set up. Specifically, 60 seconds to 120 seconds assigned to the continue mode are shifted to 120 seconds to 180 seconds. Of course, the printing with postcards may be executed in the group mode.

A reference will be made to FIG. 12 for describing a first modification of the above embodiment. The modification is similar to the embodiment except for the following. As shown, an additional sorter 2A is serially connected to the downstream side of the sorter 2. The multi-sorter sensor 8 (FIG. 11) is connected to the sorter controller 4 in order to detect the serial connection of the sorters 2 and 2A if printings derived from a single document are sequentially distributed to the bins of the sorters 2 and 2A. A transport unit 165 is positioned at the bottom of the bin unit 50 of the sorter 2 and faces the downstream end of the intermediate transport device 52. When the continue mode or the group mode is selected on the mode select key 83, the sorter controller 4 increases the moving speed more than in the above-mentioned continuous mode or the group mode.

The sorter 2A is identical in construction with the sorter 2. Hence, with the above arrangement, forty bins are available in total. The transport unit 165 is similar in configuration to the intermediate transport device 52 and includes belts 165*a*. The belts 165*a* are passed over a drive roller 165*b* connected to a motor, not shown, and a driven roller 165*c*. Each belt 165*a* is formed with a plurality of openings, not shown. A suction unit 166 has a fan, not shown, for sucking air from between the opposite runs of the belts 165*a* so as to retain a printing, not shown, on the belts 165*a*. The downstream end of the transport unit 165 faces a paper inlet 67 formed in the sorter 2A. The motor for driving the drive roller 165*b* and a motor for driving the fan are electrically connected to the sorter controller 4 via respective drivers, not shown.

The sorter 2A has a bin unit 170 having a stack of bins 171*a*–171*t*, and moving means, not shown, for moving the bin unit 170 up and down. Printings sequentially conveyed by the transport unit 165 are distributed to the bins 171*a*–171*t* in a manner matching a mode selected. The moving means has the same construction as the moving means 69 of the sorter 2. The previously mentioned multi-sorter sensor 8 is located at a predetermined position on the sorter 2 and implemented as an electric switch. A communication line is laid between the sorters 2 and 2A. In FIG. 12, the master making section 21, master discharge section 19 and so forth of the printer 1 are not shown.

Figure 12:
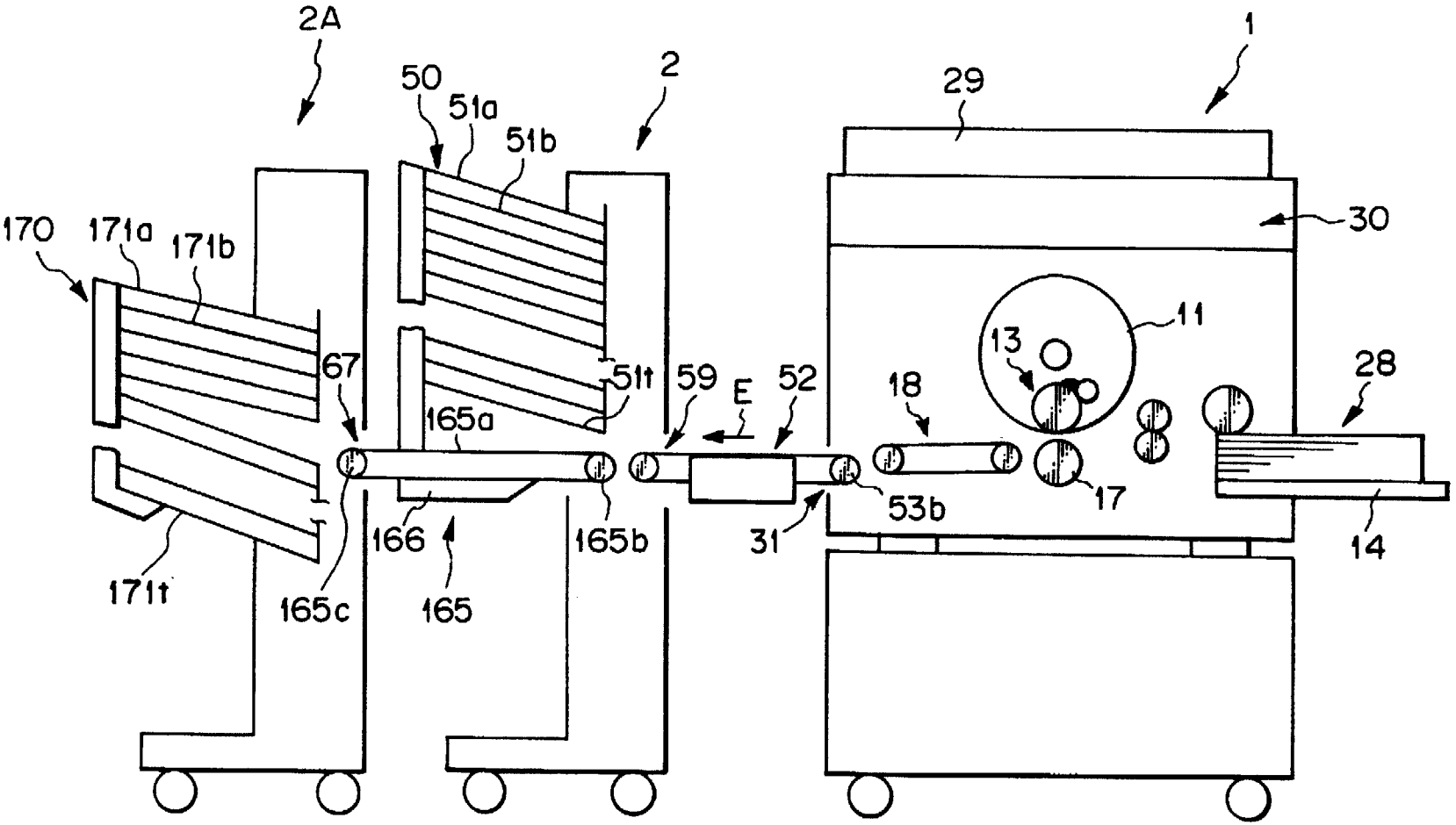
FIG. 12 is a section showing a condition wherein another sorter is serially connected to the first embodiment.

Assume that the operator desires to produce fifty clean printings with a single document in the continue mode in the arrangement of FIG. 12, and that use is made of PPC papers of size A4 (represented by the paper type data code No. 14 assigned W Ricoh PPC TYPE 6200) and positioned endways. First, the operator sets a single document, not shown, on the tray 29*a* of the ADF 29, and then presses the mode select key 83 three times. In response, the LED 84*c* assigned to the continue mode turns on. As the operator inputs "50" which is the desired number of printings on the numeral keys. 81, "50" appears on the display 91. Subsequently, the operator presses the speed set key 96 to start the paper transport speed set mode and inputs the code number "14" on the numeral keys 81. In response, a message "Type of papers: 14 . . . copy papers" appears on the display 90. Thereafter, the operator presses the speed down key 79 to select, for example, "level 3". If the operator does not press the key 79, "level 4" which is the standard speed is automatically set up.

The first printing to the twentieth printing are sequentially distributed to the bins 51*a*–51*t* of the first sorter 2, while the bin unit 50 is sequentially elevated. When the twentieth printing is fully received in the bin 51*t*, the sorter controller 4 causes the motor of the transport unit 165 and the motor of the suction unit 166 to start operating in synchronism with the intermediate transport device 52 operating at the transport speed adequate for paper positioning (1050 mm/sec). Subsequently, the twenty-first to fortieth printings are sequentially conveyed by the transport unit 165 and driven into the bins 171*a*–171*t* of the second sorter 2A. When the fortieth printing is fully received in the bin 171*t*, the printer 1 ends its printing operation. Then, the bin units 50 and 170 of the sorters 2 and 2A, respectively, are lowered slowly to their home positions.

At the end of the printing operation, the transport unit 164 is rotated downward about its rear end to a home position. On the other hand, when the bin unit 50 is sequentially elevated, as stated above, the transport unit 165 is sequentially rotated upward about its rear end. In the specific configuration shown in FIG. 12, a sufficient period of time is available until a printing has been discharged onto the underlying printing, even if the bin units 50 an d 170 are returned to their home positions at a higher speed than when the sorter 2 is used alone. Hence, when the serial connection of the sorters 2 an 2A is detected by the sensor 8, the LED 88 assigned to the multi-sorter mode turns on. Then, the sorter controller 4 shifts the moving speed to the higher side than when the continue mode is selected in the absence of the sorter 2A. For example, the moving speeds of the bin units 50 and 170 corresponding to "level 7" to "level 1" are shifted to a range of 20 bins per 30 seconds to 60 seconds. The printing with the configuration of FIG. 12 may, of course, be effected in the group mode.

While the above modification uses two sorters 2 and 2A connected in series, it is, of course, practicable even with three or more sorters.

2nd Embodiment

Figures 11, 11A, 11B:
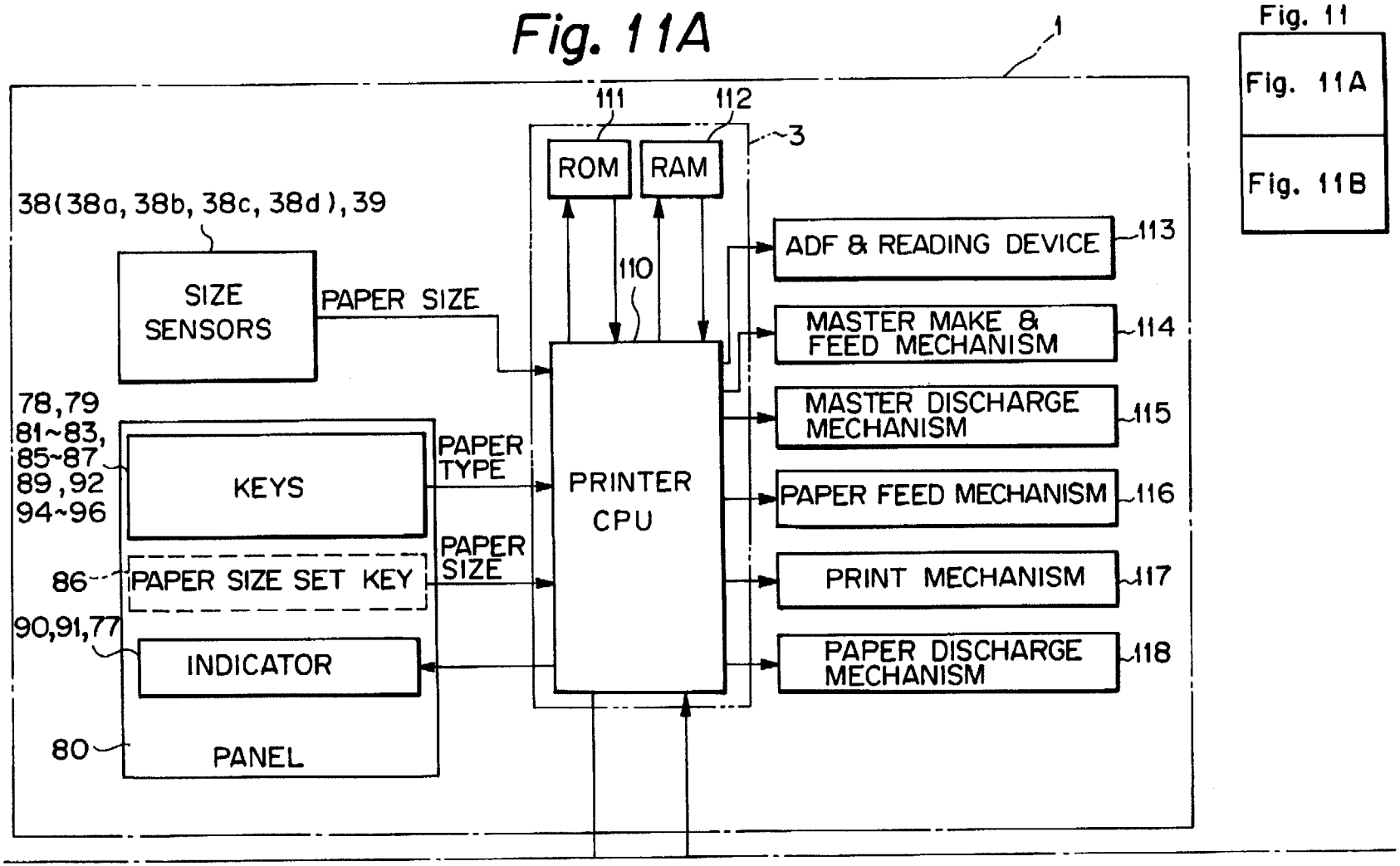
FIG. 11 is a block diagram schematically showing a control system with which the embodiment and an alternative embodiment of the present invention are practicable.
Figure 11B:
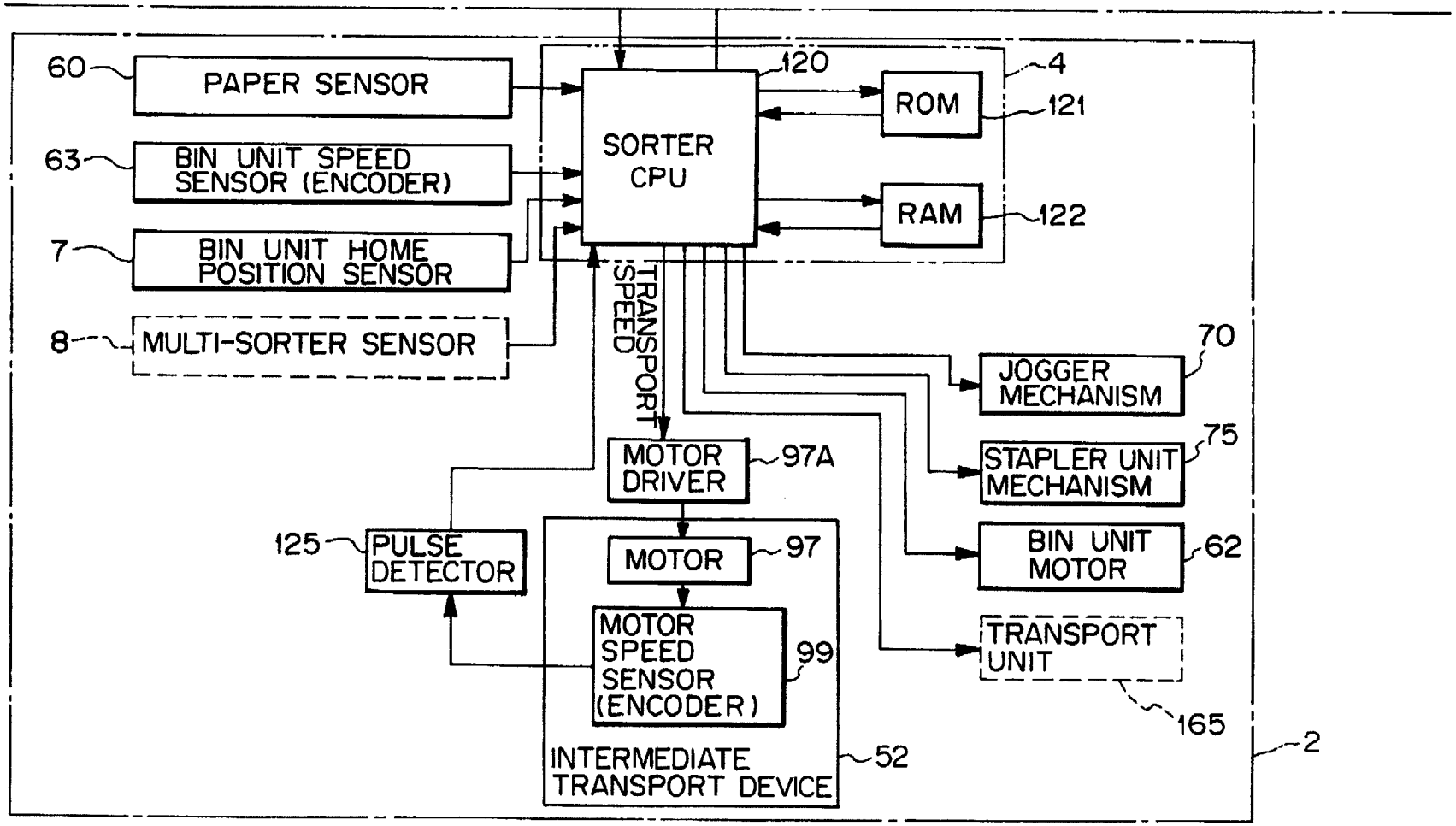

Referring to FIGS. 10 and 11, a second embodiment of the present invention will be described. This embodiment is similar to the first embodiment and the first modification thereof except for the following. The size sensors 38 and 39, playing the role of size sensing means, are omitted and replaced with the paper size set key 86, FIGS. 10 and 11. The sorter controller 4 changes the paper transport speed in response to a data signal output from the paper size set key 86. When the paper size set key 86 is pressed, paper sizes, e.g., "A4 sideways", "B4 endways" and so forth listed in Table 3 appear on the display 90 (or display 91). Every time the key 86 is pressed, the side of the papers P on the display 90 or 91 is scrolled. When the size of the papers P actually stacked on the tray 14 is shown on the display 90, the operator presses the enter key 92. In response, a paper size signal is input to the printer controller 3.

As stated above, when the mechanism for sensing a paper size is absent, various command signals can be output as in the first embodiment only if the paper size is input on the paper size set key 86.

For example, when the postcard size is input on the paper size set key 86 and the continuous mode or the group mode is input on the mode select key 83, the sorter controller 4 may automatically select the lowest speed of "level 1" lower than the standard "level 4" assigned to the continue mode. Again, the operator may press the speed up key 78 to select, for example "level 2" lower than the standard "level 4", as desired. Alternatively, for postcards, the moving speed may be automatically lowered than in the continue mode of the first embodiment. Specifically, while the first embodiment sets up 60 seconds to 120 seconds in the continue mode, they may be replaced with 120 seconds to 180 seconds for postcards.

A second modification of the first embodiment will be described with reference to Table 4 shown below. This modification differs from the first embodiment mainly in that a transport speed data table (10% up) is stored in the ROM 121 of the sorter controller 4 in addition to the transport speed data table of Table 3. In Table 4, rows show the kinds of sorter operation modes while columns show paper type data (code numbers) based on the types of papers in the matrix determined by the kinds of sorter operation modes and paper type data, percentages are representative of ratios by which the speeds are increased from the standard speeds of Table 3. The contents of Table 4 were determined by a series of researches and experiments. Importance is attached to preventing at least the trailing edge portion of the paper Pa from being left at the outside of the bin 51 and causing a jam, rather than to enhancing the positioning of the paper Pa on the bin 51.

In the sort and staple mode, positioning printings is the issue of primary importance. Hence, this mode is executed in accordance with the contents of Table 3 which are determined with priority given to the positioning of printings. On the other hand, in the sort mode and group mode, the standard speeds of Table 3 are incremented by 10% without exception with priority given to the obviation of a jam attributable to the defective reception of printings in the bin 51. A system for calling the transport speeds of Table 4 will be referred to as a 10% up mode hereinafter.

TABLE 4

| Printer SP mode | | Kind of Sorter Operation Mode | | |
|---|---|---|---|---|
| Data Code No. | 10% Up Mode | Sort & Staple Mode | Sort Mode | Group Mode |
| 15 | ON | speeds of No. 15 of Table 3 | 10% | 10% |
| 14 | ON | speeds of No. 14 of Table 3 | 10% | 10% |
| 13 | ON | speeds of No. 13 of Table 3 | 10% | 10% |
| 12 | ON | speeds of No. 12 of Table 3 | 10% | 10% |
| 11 | ON | speeds of No. 11 of Table 3 | 10% | 10% |
| 10 | ON | 0% | 10% | 10% |

The 10% up mode of Table 4 is executed in a printer setting SP (Serviceman Program) mode implemented by various keys arranged on the panel 80. Specifically, a serviceman starts the SP mode by operating various keys, starts the paper transport speed set mode, and then inputs paper type data codes, as stated earlier. Subsequently, when any one of the paper type data code Nos. 10–15 is input, the picture on the display 90 is changed and shows "10% up mode ON:1 or OFF:0" for urging the operator to select one of them. To select the 10% up mode, the operator presses the numeral key "1" and then the enter key 92.

The first embodiment, first and second modifications thereof, and second embodiment described above may be modified as follows.

(1) In the first embodiment and modifications thereof, there may be omitted the speed up key 78, speed down key 79, speed indicator 77, bin unit speed sensor 63, and moving speed setting means.

(2) In the second embodiment, there may also be omitted the speed up key 78, speed down key 79, moving speed indicator 77, bin unit speed sensor 63, and moving speed setting means.

(3) For applications not needing precise or delicate control over the paper transport speed, the first and second embodiments may have the paper type setting means or the paper size sensing means omitted. Further, the second embodiment may have only the paper size setting means omitted.

(4) In the embodiments and modifications, all the printings Pa produced in the non-sort mode are driven into the top bin 51*a* without exception. Alternatively, there may be provided an exclusive non-sort tray, not shown, having side fences and an end fence and capable of accommodating a great number of printings sequentially driven out of the printer 1.

(5) The top bin 51*a* or 171*a* of each bin unit 50 or 170 has been shown and described as facing the paper inlet 59 or 67 when the bin unit reaches the home position. Alternatively, the home positions of the bin traits 50 and 170 may be such that their bottom bins 51*t* and 171*t* face the paper inlets 59 and 67, respectively. In this case, the bin unit home position sensors will be so positioned as to sense the top bins 51*a* and 171*a*, respectively; the moving speeds refer to the speeds at which the bin units 50 and 170 are elevated to their home positions.

(6) The mode select key 83, LEDs 84 for mode display, speed up key 78 and speed down key 79 may be arranged on a panel mounted on the sorter 2.

(7) While the speed data table or tables are stored in the ROM 111 of the printer controller 3, they may be stored in the ROM 121 of the sorter controller 4.

(8) The function of the transport speed control means may be assigned to the printer controller 3.

(9) The printer controller 3 and sorter controller 4 may be implemented by, for example, microprocessors, if desired

(10) The transport speed control means of the sorter may be connected not only to the stencil printer but also to any other type of printer, e.g., intaglio printer or an electrophotographic copier or similar copier or may be mounted integrally thereon.

In summary, it will be seen that the present invention has various unprecedented advantages as enumerated below.

(1) At least the protrusion of the trailing edge portion of a paper from a bin and, therefore, jams and other troubles attributable thereto are obviated. In addition, the accurate positioning of papers on a bin is enhanced.

(2) When the operator desires accurate positioning of papers on bins in consideration of the thickness, type and size of papers, the area of an image, and other factors, the operator can increase the upward or downward moving speed of a bin unit to its home position so as to take advantage of vibration. On the other hand, when the operator gives priority to a noise and vibration-free environment, the operator can lower the moving speed. In this way, the operator or user can select a movement speed matching the intentions.

(3) When a continue mode or a group mode is selected on predetermined means, moving speed setting means automatically lowers the moving speed than when a sort mode is selected by sort mode setting means. As a result, the bin unit is raised or lowered slowly so as to guarantee the time for ink to be fixed on papers. This prevents the ink from being transferred from the front of an underlying paper to the rear of an overlying paper. In addition, the operation produces a minimum of noise and vibration.

(4) When a sort and staple mode is selected, papers must be positioned on bins with high accuracy. In this mode, the moving speed setting means automatically increases the moving speed than when a sort mode without stapling is selected on the sort mode setting means. As a result, the positioning of papers on bins, i.e., the sort and staple mode operation can be executed with higher accuracy.

(5) The moving speed setting means automatically selects a particular moving speed for each of the postcard size and the other sizes. Hence, the bin unit is raised or lowered more slowly when postcards are used than when ordinary papers are used. This surely frees postcards from smearing on their rear surfaces.

(6) When the total number of bins is multiplied, it is possible to increase the set values of the moving speed in the continue mode or the group mode, compared to a case wherein a single bin unit is used. Hence, when a plurality of sorters are connected in series and the continuous mode or the group mode is selected, the speed setting means automatically sets up a higher moving speed than in the continue mode or the group mode executed with a single sorter. This successfully reduces the total interval between the discharge of a used master and the sorting.

Various modifications will become possible for those skilled in the an after receiving the teachings of the present disclosure without departing from the scope thereof.

What is claimed is:

1. A sorter for sorts papers sequentially coming out of an image forming apparatus and each carrying an image thereon, comprising:

a bin unit having a plurality of bins that receives and stacks the papers;

an intermediate transport unit disposed between said bin unit and said image forming apparatus, and which transports the papers to said bin unit at a predetermined transport speed;

a paper size detector which detects a size of the papers in two dimensions;

a memory configured to hold predetermined parameters associated with respective of plural paper sizes; and a transport speed control unit configured to retrieve from said memory one of said predetermined parameters, as a predetermined parameter, associated with the size of the papers detected by said paper size detector and configured to control said predetermined transport speed based on said predetermined parameter.

2. A sorter as claimed in claim 1, wherein said paper size detector detects paper sizes in the range 90 to 318 mm in a first dimension and in the range of 148 to 432 mm in a second dimension.

3. A sorter as claimed in claim 1, wherein said transport speed control unit comprises control means for changing said predetermined transport speed on the basis of the size of the papers detected by the paper size detector.

4. A sorter as claimed in claim 3, wherein the predetermined parameter further comprises a type of the papers including at least one of a thickness and a quality.

5. A sorter as claimed in claim 4, wherein said transport speed control unit further comprises:

paper type setting means for setting the type of the papers;

said control means changing said predetermined transport speed on the basis of the type of the papers set by said paper type setting means, and the size detected.

6. A sorter as claimed in claim 1, wherein the predetermined parameter comprises a type of the papers including at least one of a thickness and a quality.

7. A sorter as claimed in claim 6, wherein said transport speed control unit comprises:

paper type setting means for setting the type of the papers; and control means for controlling said predetermined transport speed on the basis of the type of the papers set.

8. A sorter as claimed in claim 1, wherein said transport speed control unit comprises:

setting means for manually setting a size of the papers; and control means for controlling said predetermined transport speed based on at least one of said predetermined parameter and the manually set size of said papers set by said setting means.

9. A sorter as claimed in claim 8, wherein the setting means manually sets a thickness of the papers in addition to said size of said papers.

10. A sorter as claimed in claim 9, wherein said transport speed control means further comprises: paper type setting means for setting the type of the papers;

said control means changing said predetermined transport speed on the basis of the type set and the size set.

11. A sorter as claimed in claim 1, further comprising:

bin unit driving means for selectively moving said bin unit upward or downward, and for moving said bin unit to a home position after the papers have been fully sorted to said plurality of bins;

moving speed inputting means for selectively setting one of a plurality of predetermined moving speeds for said bin unit driving means to move said bin unit to said home position; and control means for changing a moving speed of said bin unit to said home position on the basis of the moving speed set.

12. A sorter as claimed in claim 11, further comprising: sort mode inputting means for setting a sort mode for sorting, when the papers are derived from a plurality of pages of documents, said papers to each of said plurality of bins in order of page; and continuous mode or group mode inputting means for setting a continuous mode or a group mode for distributing, when the papers are derived from a single document, said papers to said plurality of bins one by one;

said control means lowering, when said continuous mode or said group mode is selected, the moving speed of said bin unit than when said sort mode is selected.

13. A sorter as claimed in claim 11, further comprising:

a stapler unit for sequentially stapling the papers stacked on said plurality of bins;

sort mode inputting means for setting a sort mode for sorting, when the papers are derived from a plurality of pages of documents, said papers to each of said plurality of bins in order of page; and sort and staple mode inputting means for setting a sort and staple mode for automatically sorting the papers and then stapling said papers;

said control means increasing, when said sort and staple mode is selected, the moving speed of said bin unit than when said sort mode is selected.

14. A sorter as claimed in claim 11, further comprising:

size detecting means for detecting a size of the papers;

said control means further lowering the moving speed of said bin unit when the size detected is a postcard size and a continuous mode or a group mode is selected.

15. A sorter as claimed in claim 11, further comprising:

size setting means for setting a size of the papers;

said control means further lowering the moving speed of said bin unit when the size set is a postcard size and a continuous mode or a group mode is selected.

16. A sorter as claimed in claim 11, wherein a plurality of said sorters are serially connected to said image forming apparatus, said control means further raising the moving speed or said bin unit when a continuous mode or a group mode is selected for sequentially distributing, when the papers are derived from a single document, said papers to the bins of said plurality of sorters.

17. A sorter as claimed in claim 1, wherein said image forming apparatus comprises a stencil printer.

18. A device for controlling an intermediate transport unit for transporting papers sequentially coming out of an image forming apparatus to a plurality of bins of a bin unit of a sorter at a predetermined transport speed, said device comprising:

size detecting means for detecting a size of the papers in two dimensions and producing a corresponding predetermined parameter particular to the papers; and control means for changing said predetermined transport speed based on the predetermined parameter produced by said size detecting means.

19. A device as claimed in claim 18, further comprising: paper type setting means for setting a type of the papers including at least one of a thickness and a quality;

said control means changing said predetermined transport speed on the basis of the type of the papers set, and the size detected.

20. A device for controlling an intermediate transport unit for transporting papers sequentially coming out of an image forming apparatus to a plurality of bins of a bin unit of a sorter at a predetermined transport speed, said device comprising:

paper type setting means for setting a type of the papers including at least one of a thickness and a quality; and control means for changing said predetermined transport speed on the basis of the type set.

21. A device for controlling an intermediate transport unit for transporting papers sequentially coming out of an image forming apparatus to a plurality of bins of a bin unit of a sorter at a predetermined transport speed, said device comprising;

size setting means for setting a size of the papers; and control means for changing said predetermined transport speed on the basis of the size set.

22. A device as claimed in claim 21, further comprising:

paper type setting means for setting a type of the papers including at least one of a thickness and a quality;

said control means changing said predetermined transport speed on the basis of the type set and the size set.

23. A sorter for sorting papers sequentially coming out of an image forming apparatus and each carrying an image thereon, said sorter comprising:

a bin unit having a plurality of bins for receiving and stacking the papers;

an intermediate transport unit disposed between said bin unit and said image forming apparatus, for transporting the papers to said bin unit at a predetermined transport speed, said intermediate transport unit having a belt and a suction unit for retaining each of the papers on the belt;

a paper size detector for detecting a size of the papers;

a memory configured to hold predetermined parameters associated with respective of plural paper sizes; and a transport speed control unit configured to retrieve from said memory one of said predetermined parameters, as a predetermined parameter, associated with the size of the papers detected by said paper size detector and configured to control said predetermined transport speed based on said predetermined parameter.

24. A sorter as claimed in claim 23, wherein said transport speed control unit comprises control means for changing said predetermined transport speed on the basis of the size of the papers detected by said paper size detector.

25. A control device for controlling an intermediate transport unit for transporting papers sequentially coming out of an image forming apparatus to a plurality of bins of a bin unit of a sorter at a predetermined transport speed, said intermediate transport unit having a belt and a suction unit for retaining each of the papers on the belt, said control device comprising:

size detecting means for detecting a size of the papers and producing a corresponding predetermined parameter particular to the papers; and control means for changing said predetermined transport speed based on the predetermined parameter produced by said size detecting means.

26. A sorter which sorts papers sequentially coming out of an image forming apparatus and each carrying an image thereon, comprising:

a bin unit having a plurality of bins that receives and stacks the papers;

an intermediate transport unit disposed between said bin unit and said image forming apparatus, and which transports the papers to said bin unit at a predetermined transport speed;

a paper size detector which detects a size of the papers in two dimensions and produces a corresponding predetermined parameter particular to the papers; and a transport speed control unit which controls said predetermined transport speed based on the predetermined parameter, said transport speed control unit comprising paper type setting means for setting the type of the papers including at least one of a thickness and a quality and control means changing said predetermined transport speed based on the type of the papers set by said type setting means, and the size detected.

27. A sorter which sorts papers sequentially coming out of an image forming apparatus and each carrying an image thereon, comprising:

a bin unit having a plurality of bins that receives and stacks the papers;

an intermediate transport unit disposed between said bin unit and said image forming apparatus, and which transports the papers to said bin unit at a predetermined transport speed;

paper type setting means for setting the type of the papers included at least one of a thickness and a quality; and a transport speed control means which controls said predetermined transport speed based on the type of the papers set.

28. A sorter which sorts papers sequentially coming out of an image forming apparatus and each carrying an image thereon, comprising:

a bin unit having a plurality of bins that receives and stacks the papers;

an intermediate transport unit disposed between said bin unit and said image forming apparatus, and which transports the papers to said bin unit at a predetermined transport speed;

a paper size detector which detects a size of the papers in two dimensions and produces a corresponding predetermined parameter particular to the papers; and transport speed control unit which controls said predetermined transport speed based on the predetermined parameter, said transport speed control unit comprising setting means for manually setting a size of the papers and control means for controlling said predetermined transport speed based on at least one of said predetermined parameter and the manually set size of said papers set by said setting means.

29. A sorter which sorts papers sequentially coming out of an image forming apparatus and each carrying an image thereon, comprising:

a bin unit having a plurality of bins that receives and stacks the papers;

an intermediate transport unit disposed between said bin unit and said image forming apparatus, and which transports the papers to said bin unit at a predetermined transport speed;

a paper size detector which detects a size of the papers in two dimensions and produces a corresponding predetermined parameter particular to the papers;

a transport speed control unit which controls said predetermined transport speed based on the predetermined parameter;

bin unit driving means which selectively moves said bin unit upward or downward, and moves said bin unit to a home position after the papers have been fully sorted to said plurality of bins;

moving speed inputting means for selectively setting one of a plurality of predetermined moving speeds for said bin unit driving means to move said bin unit to said home position; and control means for changing a moving speed of said bin unit to said home position based on the moving speed set.

* * * * *

UNITED STATES PATENT AND TRADEMARK OFFICE

CERTIFICATE OF CORRECTION

PATENT NO. : 5,690,324

DATED : November 25, 1997

INVENTOR(S) : Otomo et al

It is certified that error appears in the above-identified patent and that said Letters Patent is hereby corrected as shown below:

Column 1, line 12, change "&" to --a--;

line 24, change "2-17556" to --2-175561--.

Column 3, line 26, change "Then;" to --Then,--.

Column 4, line 9, change "farther" to --further--;

line 52, change "reeds" to --feeds--.

Column 5, line 5, change "white" to --while--;

line 31, change "hid-Open" to --Laid-Open--;

line 55, change "bas" to --has--.

Column 6, line 18, change Figs, to --Figs.--.

Column 7, line 45, change "shuts" to --sheets--.

Column 9, line 20, change "star" to --start--.

Column 10, line 15, change "passes" to --presses--;and line 24, change "device" to --drive--;

line 48, change "safe" to --same--;

UNITED STATES PATENT AND TRADEMARK OFFICE

CERTIFICATE OF CORRECTION

PATENT NO. : 5,690,324

DATED : November 25, 1997

INVENTOR(S) : Otomo et al

It is certified that error appears in the above-identified patent and that said Letters Patent is hereby corrected as shown below:

Column 10, line 56, change "bias" to --bins--.

Column 11, line 11, change "51B"(second occurrence) to --51E--.

line 60, change "towering" to --lowering--.

Column 12, line 47, after "encoder" insert --63,--.

Column 13, line 29, change "sorer" to --sorter--.

Column 14, line 28, change "as n ended" to --as needed--;

line 52, delete --to-- (second occurrence);

line 54, change"anti" to --and--;

Column 16, line 35, change "dashed" to --desired--;

line 46, change "A" to --4--.

Column 17, line 51, changer "mater" to --master--.

Column 18, line 1, after "bin" insert --51a--;

line 4, change "16b," to --16b.--;

line 7, after "press the paper" insert --P--.

UNITED STATES PATENT AND TRADEMARK OFFICE

CERTIFICATE OF CORRECTION

PATENT NO. : 5,690,324

DATED : November 25, 1997

INVENTOR(S) : Otomo et al

It is certified that error appears in the above-indentified patent and that said Letters Patent is hereby corrected as shown below:

Column 19, line 51, change "ample" to --staple--;

line 63, change "opener" to --operator--.

Column 20, line 31, change "trail" to --trial--;

line 44, change "mm/see" to -- mm/sec--.

Column 21, line 1, delete the second occurrence of "the".

Column 22, line 7, change "51a a a via" to --51a via--.

line 35, change "sorer" to --sorter--;

line 45, change "150" to --50--;

line 63, change "151i" to --51i--.

Column 23, line 52, change "printer I" to --printer 1--.

Column 24, line 66, change "W" to --to--.

Column 25, line 5, change "keys." to --keys--;

UNITED STATES PATENT AND TRADEMARK OFFICE

CERTIFICATE OF CORRECTION

PATENT NO. : 5,690,324

DATED : November 25, 1997

INVENTOR(S) : Otomo et al

It is certified that error appears in the above-identified patent and that said Letters Patent is hereby corrected as shown below:

line 37, change "an d" to --and--.

line 40, change "2 an 2A" to --2 and 2A".

Column 27, line 33, change "traits" to --units--;

line 52, after "desired" insert --.--.

Column 28, line 44, change "an" to --art--;

In the Claims:

Claim 1, column 28, line 47, change "for" to --which--.

Claim 16, column 30, line 28, change "or" (first occurrence) to --of--.

In the Tables:

Column 7, TABLE 1, between lines 19 and 20 insert the following line which was omitted:

"- o o - o * 268 x 432".

UNITED STATES PATENT AND TRADEMARK OFFICE

CERTIFICATE OF CORRECTION

PATENT NO. : 5,690,324

DATED : November 25, 1997

INVENTOR(S) : Otomo et al

It is certified that error appears in the above-identified patent and that said Letters Patent is hereby corrected as shown below:

Column 26, TABLE 4, line 51, column 1, insert "Paper Type".

Signed and Sealed this

Eighth Day of September, 1998

*Attest:*

Bruce Lehman

BRUCE LEHMAN

*Attesting Officer*

*Commissioner of Patents and Trademarks*